US005108029A

United States Patent [19]

Abrams et al.

[11] Patent Number: 5,108,029

[45] Date of Patent: Apr. 28, 1992

[54] RECLOSABLE ATTACHMENT FOR CONTAINERS

[75] Inventors: Robert S. Abrams, Albany; H. Carl Smith, Fultonville, both of N.Y.; Thomas Angelini; Richard Arena, both of Pittsfield, Mass.; John F. Nash, Jr., Schenectady, N.Y.

[73] Assignee: Capitol Spouts, Inc., Fultonville, N.Y.

[21] Appl. No.: 634,439

[22] Filed: Dec. 27, 1990

Related U.S. Application Data

[63] Continuation-in-part of Ser. No. 465,848, Jan. 16, 1990.

[51] Int. Cl.[5] ..... B65D 5/74; B65D 41/32

[52] U.S. Cl. ..... 229/125.09; 220/266; 220/306; 220/334; 229/125.15

[58] Field of Search ..... 229/125.09, 125.14, 229/125.15; 215/237, 245, 250, 258; 220/265, 266, 306, 334, 339; 156/153, 629; 264/334; 425/444, 556; 249/67

[56] References Cited

U.S. PATENT DOCUMENTS

| | | | |
|---|---|---|---|
| 1,140,927 | 5/1915 | Walter . | |
| 1,357,304 | 11/1920 | Valdes . | |
| 2,231,050 | 6/1943 | Seymer . | |
| 2,286,342 | 6/1942 | Calva . | |
| 2,347,686 | 5/1944 | Hothersall . | |
| 2,400,716 | 9/1942 | Sattler . | |
| 2,533,305 | 12/1950 | Wells . | |
| 2,543,909 | 3/1951 | Hatheway, Jr. . | |
| 2,676,744 | 4/1954 | Baselt . | |
| 2,784,893 | 3/1957 | Hill . | |
| 2,826,348 | 3/1958 | Schroeder et al. . | |
| 2,855,084 | 5/1959 | Rocca . | |
| 2,893,295 | 7/1959 | Magill . | |
| 2,920,806 | 1/1960 | Hill . | |
| 2,927,695 | 3/1960 | Bartolomeo . | |
| 2,983,419 | 5/1961 | Bergstein . | |
| 3,067,078 | 12/1962 | Gluck | 156/629 |
| 3,101,878 | 8/1963 | Bee . | |
| 3,131,870 | 5/1964 | Henchert . | |
| 3,135,441 | 6/1964 | Wise et al. . | |
| 3,160,327 | 12/1964 | Porcelli . | |
| 3,282,476 | 11/1966 | Tracy . | |
| 3,295,726 | 1/1967 | Hanson . | |
| 3,412,919 | 11/1968 | Cain . | |
| 3,604,596 | 9/1971 | Khoury | 220/266 |
| 3,608,771 | 9/1971 | Monroe et al. . | |
| 3,651,992 | 3/1972 | Hazard . | |

(List continued on next page.)

FOREIGN PATENT DOCUMENTS

| | | |
|---|---|---|
| 572850 | 3/1959 | Canada . |
| 1054008 | 3/1959 | Fed. Rep. of Germany . |
| 1349783 | 4/1964 | France . |

OTHER PUBLICATIONS

"Form+Function", The Wall Street Journal, John Pierson, (Dec. 14, 1989).

*Primary Examiner*—Gary E. Elkins

*Attorney, Agent, or Firm*—Burns, Doane, Swecker & Mathis

[57] ABSTRACT

A reclosable attachment for containers for permitting the contents of the container to be discharged from the container includes a flange member, a cylindrical extension that extends from one side of the flange member, and a cylindrical stem that extends from the opposite side of the flange member. A cap is connected to the flange member and is adapted to be engaged and disengaged with the cylindrical extension in order to permit or prevent the discharge of the contents from the container. A feature is also provided on the reclosable attachment for preventing someone from unknowingly tampering with the container and for preventing the cap from being accidentally opened. Several spaced apart ledges which extend radially outwardly from the outer peripheral surface of the stem can also be provided for maintaining the position of the attachment relative to the container. Additionally, axially extending annular ridges can be formed on the side of the flange member that is adapted to be secured to the container for purposes of controlling the flow of the adhesive used to secure the attachment to the container.

49 Claims, 10 Drawing Sheets

U.S. PATENT DOCUMENTS

| | | | |
|---|---|---|---|
| 3,998,354 | 12/1976 | Song . | |
| 3,999,678 | 12/1976 | Ignell et al. . | |
| 4,127,221 | 11/1978 | Vere . | |
| 4,170,315 | 10/1979 | Dubach et al. . | |
| 4,244,495 | 1/1981 | Lorscheid et al. | 220/339 |
| 4,327,842 | 5/1982 | Walter . | |
| 4,359,169 | 11/1982 | Helms et al. . | |
| 4,397,401 | 8/1983 | Ueno et al. . | |
| 4,420,089 | 12/1983 | Walker et al. | 215/250 |
| 4,483,464 | 11/1984 | Nomura . | |
| 4,533,693 | 11/1985 | Terajima et al. . | |
| 4,555,037 | 11/1985 | Rhees . | |
| 4,562,990 | 1/1986 | Rose | 264/334 |
| 4,610,371 | 9/1986 | Karkiewicz | 215/237 |
| 4,635,823 | 1/1987 | Stull . | |
| 4,648,834 | 3/1987 | Von Holdt | 264/334 |
| 4,669,640 | 6/1987 | Ando et al. . | |
| 4,711,363 | 12/1987 | Marino . | |
| 4,730,769 | 3/1988 | Stark . | |
| 4,732,315 | 3/1988 | Gunn . | |
| 4,742,928 | 5/1988 | Braun . | |
| 4,753,832 | 6/1988 | Brown et al. . | |
| 4,754,895 | 7/1988 | Lardner et al. . | |
| 4,775,098 | 10/1988 | Peer, Jr. et al. . | |
| 4,782,996 | 11/1988 | Spahni, Jr. . | |
| 4,783,056 | 11/1988 | Abrams . | |
| 4,793,501 | 12/1988 | Beck . | |
| 4,812,116 | 3/1989 | Abrams . | |
| 4,813,578 | 3/1989 | Gordon et al. . | |
| 4,852,764 | 8/1989 | Stone . | |
| 4,858,793 | 8/1989 | Stone . | |
| 4,880,155 | 11/1989 | Stone . | |
| 4,909,434 | 3/1990 | Jones et al. . | |
| 4,974,735 | 12/1990 | Newell et al. | 215/237 |

RECLOSABLE ATTACHMENT FOR CONTAINERS

This is a continuation-in-part application of application Ser. No. 07/465,848, filed Jan. 16, 1990, Pending.

FIELD OF THE INVENTION

The present invention relates to an attachment for containers. More particularly, the present invention relates to a reclosable attachment for containers that can be secured at an appropriate location on a container for permitting the container to be reclosed after a portion of the contents of the container have been discharged.

BACKGROUND OF THE INVENTION

Containers are commonly used to hold products such as milk, juices and other pourable products. It is desirable that the container be designed for repeated openings and closings so that any contents remaining in the container can be stored for use at a later time. Various prior art arrangements have been proposed in an attempt to meet that need.

For example, U.S. Pat. No. 4,782,996, discloses an openable and closable device that is attached to a container. The device includes a bottom member which is secured to the container and a cover that is hingedly connected to the bottom member. The bottom member includes a cutout portion that is aligned with a hole in the container when the device is attached to the container. A plug extending from the cover fits within the cutout portion in the base and the hole in the container. Protrusions extending from the outer peripheral edge of the plug engage the inner surface of the cutout portion in order to keep the cover in a closed position.

Similarly, in U.S. Pat. No. 2,676,744, an openable and closable closure device is attached to a container for permitting the removal of the container's contents. The device includes a bottom member having a cutout portion therein that is attached to the container so that the cutout portion is aligned with a hole in the container. A closure flap is hingedly connected to the bottom member. The closure flap has a flange which extends around the outer periphery thereof and a plug extending from a central portion thereof. In order to close the container after it has been opened, the closure flap is pushed downwardly so that the plug fits into the hole in the bottom member and extends into the interior of the container. Further, the closure flap is positioned relative to the container such that upon closure, the flange extending from the closure flap engages the outer peripheral edges of the container so that the closure flap remains closed.

Devices similar to those described above are also disclosed in U.S. Pat. Nos. 4,775,098, 2,927,695 and 2,321,050.

While the devices disclosed in the aforementioned patents permit a container to be opened and reclosed for use thereafter, those devices suffer from certain disadvantages. For example, some of those devices are designed so that the closure flap tightly engages the outer periphery of the container to which the device is attached in order that the closure flap will remain closed. Those devices must be positioned in close proximity to the peripheral edge of the container in order that flanges or the like extending from the closure flap can tightly engage the outer periphery of the container. Thus, those devices are not suitable for placement on all types of containers nor are they readily adapted to be placed anywhere on a container.

Also, if the top surface of the apertured bottom member through which the contents of the container are poured when the closure flap is open is substantially planar, it may be more difficult to pour the contents of the container through the aperture because there is no structure surrounding the aperture to control the flow of the contents, e.g. liquid, as it passes through the aperture. Thus, there is a tendency for the liquid to spill, drip and flow out of the container in an uncontrollable manner.

Another disadvantage is that the closure flap has a plug extending therefrom that fits through a cutout in the bottom member which is aligned with the hole in the container. Oftentimes, those devices rely upon the frictional engagement between the outer periphery of the plug and the inner wall of the cutout portion and/or the hole in the container in order to maintain the closure flap in the closed position. In the case of liquids, problem arises when the liquid in the container is poured through the cutout portion and the hole because residual liquid will adhere to the inner wall surface of the aperture and the cutout portion. Thus, when the closure flap is closed and the outer periphery of the plug engages the inner wall surface of the cutout portion and/or the aperture, the closure flap may actually become stuck in the closed position as a result of the sticky residual liquid on the inner wall surface. Further, the closure flap may not seal correctly.

Another problem is that the container to which the opening device is attached must be specifically adapted to receive the opening device. For example, the container may require a specific edge construction in order to securely hold the closure flap in the closed position or the container may require a laminated structure that will permit a portion of the opening device to be positioned between layers of the laminate. Such constructions limit the usefulness of the opening device because the opening device can only be used in conjunction with the specific container for which it was designed.

An additional drawback is that the opening device and the container are manufactured from the same material and are manufactured as an integral structure. Thus, the container must be specially manufactured to include the opening device. Further, such a construction offers no flexibility with respect to the positioning and orientation of the opening device.

When the product contained in the container is a product that is to be used or consumed by people, special concerns arise with respect to the possibility that the product may become contaminated or adulterated as a result of tampering. Notwithstanding the health and safety risks posed by such tampering, many of the prior art opening arrangements are not designed to permit a user to readily realize that the opening arrangement has been tampered with and that the contents in the container may not be fit for use or consumption.

Further, there is a concern that the opening arrangement may be inadvertently opened during handling and storage. Some prior art opening arrangements are not constructed to address this possibility and thus, are susceptible to undesirable spillage and emptying.

When adhesives are utilized to secure the opening arrangement to the container, it is desirable to control the placement of the adhesive and prevent it from flowing outwardly beyond the edges of the opening arrangement. In that way, the clean and attractive appearance of the container will not be diminished and the possibility that the adhesive will infiltrate the contents in the container will be avoided.

When the opening arrangement includes a stem that is to be inserted in a hole in the container, the position of the opening arrangement relative to the container must be maintained until the opening arrangement has been secured through suitable means to the container. Otherwise, a tight seal will not be obtained.

SUMMARY OF THE PRESENT INVENTION

In view of the foregoing disadvantages and drawbacks associated with prior opening devices for attachment to containers, and in light of the aforementioned considerations, it is an object of the present invention to provide a reclosable attachment for containers that is adapted to be placed at any desired location on the container so that other than the hole in which the opening arrangement is positioned, the container need not be specially designed to accommodate the attachment.

It is also an object of the present invention to provide a reclosable attachment for containers that is designed to facilitate the pouring of liquids from the container in order to avoid spillage, dripping and uncontrollable flow of the contents.

It is another object of the present invention to provide a reclosable attachment for containers that is designed so that the closure member does not come in contact with any residual contents from the container that may cause the closure member to become stuck with respect to the base member.

It is a further object of the present invention to provide a reclosable attachment for containers that can be positioned on any type of container.

Another object of the present invention is to provide a reclosable attachment for containers that can be quickly and easily positioned at the desired location on the container.

Still another object of the present invention is to provide a reclosable attachment for containers that is safe and tamper evident, thereby ensuring that the contents will not be unknowingly adulterated or otherwise contaminated.

A still further object of the present invention is to provide a reclosable opening arrangement that is not prone to being inadvertently opened during handling and storage.

It is another object of the present invention to provide a reclosable opening arrangement that is constructed to ensure that the opening arrangement maintains its position relative to the container so that the opening arrangement can be securely attached to the container.

The foregoing objects and other objects that will become apparent hereinafter are achieved as a result of the arrangement of features of the reclosable attachment according to the preferred embodiments of the present invention.

According to one aspect of the present invention, the reclosable attachment includes a flange member having first and second sides and an aperture extending therethrough, an extension integrally connected to and extending axially from the second side of the flange member, and a stem integrally connected to and extending axially from the first side of the flange member. The stem is adapted to be positioned in a hole in the container. The extension and the stem have openings extending therethrough that are axially aligned with the aperture in the flange member so that the contents of the container can be emptied through the stem, the flange member and the extension. A cap is connected to the flange member and is adapted to be moved between an open position for permitting the contents to be discharged from the container and a closed position for preventing the contents from being emptied from the container.

The outer periphery of the flange member may be provided with outwardly extending knockout portions for maintaining the structural integrity of the attachment during removal from the mold. The reclosable attachment can also be provided with a feature for indicating if the container and/or its contents have been tampered with and for preventing the attachment from being accidentally opened during shipping and handling.

In accordance with another aspect of the present invention, the outer peripheral surface of the stem can be provided with several outwardly extending ledges which help facilitate maintaining the position of the reclosable attachment relative to the container. Additionally, the first side of the flange member can be provided with two annular ridges, one positioned adjacent the outer edge of the flange member and the other positioned adjacent the stem, for controlling the flow of the adhesive that may be used to secure the reclosable attachment to the container.

DESCRIPTION OF THE DRAWINGS

Preferred embodiments of the present invention will be described in greater detail with reference to the accompanying drawings, wherein like members bear like reference numerals and wherein.

DETAILED DESCRIPTION OF THE PREFERRED EMBODIMENTS

Figure 1:
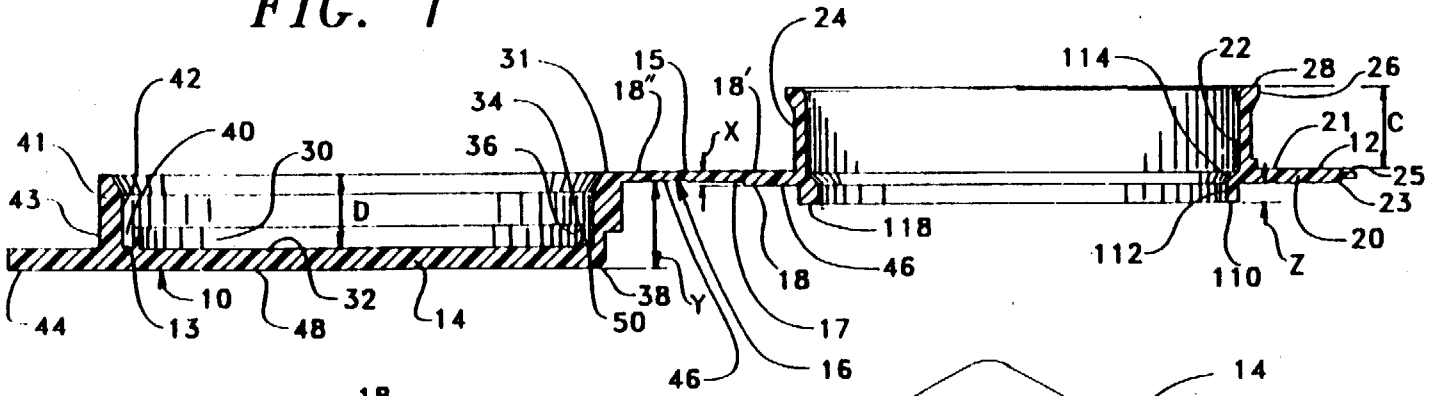
FIG. 1 is a cross-sectional view of the reclosable attachment according to one embodiment of the present invention showing the attachment in a fully open position.

With initial reference to FIG. 1, the reclosable attachment 10 according to a first embodiment of the present invention includes a base member 12 and an integrally connected cap 14. The base member 12 and the cap 14 are connected to one another by a strip of connecting material 18. The connecting member 18 is integrally connected to and formed in one piece with the base member 12 and the cap 14. Also, the connecting member 18 is connected to and extends radially outwardly from the outer peripheral edge portion of the base member 12 and the cap 14.

The base member 12 includes a substantially planar flange member 20 having an aperture 22 extending completely therethrough. Extending upwardly from the top surface of the flange member 20 is a short cylindrical extension 24 having a hollow interior. The aperture 22 in the flange member 20 is substantially coaxial with respect to the cylindrical extension 24. Further, the cylindrical extension 24 is integrally formed in one piece with the flange member 20.

A hinge 16 is located on the connecting member 18 between the base member 12 and the cap 14. The hinge 16 is defined by a cutout portion 17 on one side of the connecting strip 18 and a delimiting line 15 located opposite to the cutout portion and on the opposite side of the connecting member 18. The hinge 16 is specifically designed to permit the cap 14 to pivot in an unrestricted manner relative to the base member 12 without being broken or separated from the base member 12.

As best seen in FIG. 1, the connecting member 18 ensures that the motion of the hinge 16 is not affected when the reclosable attachment 10 is secured to a container. In particular, the connecting member 18 is formed with respect to the other portions of the reclosable attachment 10 such that the bottom surface 46 on portion 18' of the connecting member 18 is elevationally higher than and spaced from the bottom surface 23 of the flange member 20. Stated differently, the plane of the face 46 of the portion 18' and the plane of the bottom surface 23 of the flange portion 20 are not coplanar. That construction helps ensure that when the appropriate attaching means (e.g., pressure sensitive adhesive, heat and pressure seal, sonic welding, a combination of one of the foregoing methods and chemical etching of the bottom surface of the attachment, etc.) is used to secure the bottom surface 23 of the flange member 20 to the exterior surface of the container, the bottom surface 46 of portion 18' of the hinge member 18 is raised from the exterior surface of the container so that the bottom surface 46 does not also become attached to the exterior surface of the container when the reclosable attachment 10 is being secured or attached to the container. It can be readily seen that if the bottom surface 46 of portion 18' of the connecting member 18 were coplanar with the bottom surface 23 of the flange member 20, the bottom surface 46 of the portion 18' (as well as at least a portion of the hinge 16) could also become attached to the exterior surface of the container. Attachment of the bottom surface 46 and a portion of the hinge 16 to the exterior surface of the container could, of course, adversely effect the operation of the hinge 16. The portion 18" of the connecting member 18 that is integrally connected to and formed in one piece with the cap 14 has a surface opposite to the bottom surface 46 which is substantially coplanar with the bottom end face 31 of the cap 14.

Near the top of the cylindrical extension 24 is located an annular ridge 26. The annular ridge 26 and a smooth transition surface at the upper edge 28 of the cylindrical extension 24 provide an annular region for interlocking with the cap 14. The cylindrical extension 24 extends above the top surface 21 of the flange 20 a distance sufficient to permit the cap 14 to interlock with the annular ridge 26 and the smooth transition at the upper edge 28 of the cylindrical extension 24.

In the embodiment of the reclosable attachment illustrated in FIG. 1, the bottom surface 23 of the flange member 20 is substantially planar. The planar nature of the bottom surface 23 permits the entire bottom surface to rest against and be attached to the exterior surface of the container by whatever attaching means is utilized to secure the reclosable attachment 10 to the container.

The cap 14 includes a depression or recess 30 having an inner surface 32. An integrally formed annular seal 34 extends away from the inner surface 32. The seal 34 is provided with an inner edge 36 and an outer edge 38. A gap 40 which defines an annular recess or groove 13 is provided between the outer edge 38 of the annular seal 34 and the inner wall 42 of the cap 14.

The annular seal 34, the gap 40, and the portion of the cap 14 connecting those two parts together define a region that is adapted to interlock with the annular ridge 26 on the cylindrical extension 24 when the cap 14 is brought into engagement with the cylindrical extension 24. When the cap 14 is closed, the cap 14 fits over the cylindrical extension 24 so that the peripheral wall 41 of the cap 14 encircles the outer periphery of the cylindrical extension 24. Thus, the outer periphery 43 of the cap 14 is positioned on the outside of or exterior of the hollow interior of the cylindrical extension 24.

The tight interengagement between the annular ridge 26 and the portion of the cap 14 into which the annular ridge 26 fits produces a very good seal that is air-tight and liquid-tight, even after repeated opening and closing of the cap 14. The need for a strong seal that is liquid-tight is particularly important because during transportation, storage and handling of the container, the liquid in the container undergoes considerable jostling. Moreover, it is oftentimes desirable to shake the container in order to mix the contents thereof prior to pouring the contents from the container. The liquid-tight nature of the seal prevents the contents of the container from spilling or dripping out of the container when the container is shaken in such a manner. Similarly, the air-tight nature of the seal is important in order to permit the container and its contents to be stored for extended periods without becoming spoiled. A particularly suitable liquid-tight and air-tight seal can be manufactured by the process disclosed in U.S. Pat. No. 4,783,056.

A finger or release tab 44 extends from the upper peripheral edge of the cap 14 in order to permit the cap 14 to be opened when the cap 14 is in the closed position on the cylindrical extension 24. Since, as will be discussed in more detail later, the reclosable attachment is designed such that the bottom surface of the cap 14 contacts the top surface 21 of the flange member 20, it is necessary that sufficient space be provided between the finger tab 44 and the top surface 21 of the flange member 20 to permit access to the finger tab 44. The location of the finger tab 14 on the upper peripheral edge of the cap 14 ensures that the user can easily access the finger tab 44 even when the axial height of the cylindrical extension 24 is very small.

In the preferred construction, the finger tab 44 extends outwardly from the cap 14 a distance sufficient to ensure that the outer edge of the finger tab 44 is at least coincident with the outer peripheral edge of the flange member 20. It may be desirable in some instances, however, depending upon, for example, how the reclosable attachment is mounted to the container, to construct the finger tab 44 such that it extends beyond the edge of the flange 20.

Figure 2:
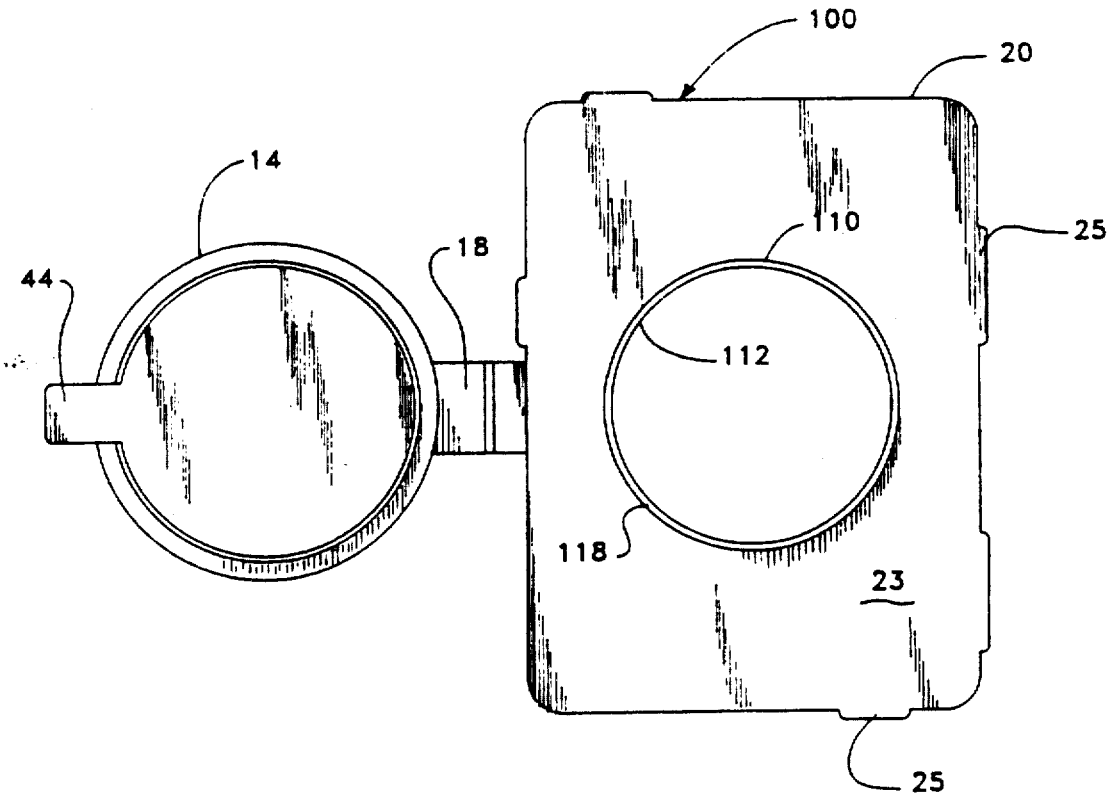
FIG. 2 is a bottom plan view of the reclosable attachment of FIG. 1 in an open and flat position.

Turning to FIG. 2, the flange member 20 of the base member 12 is depicted as being substantially rectangular. It is to be understood, however, that the flange member 20 could be of any shape desired. The shape of the flange member 20 may depend, in part, upon the particular place on the container to which the reclosable attachment 10 is secured as well as the particular container to which the reclosable attachment 10 is secured.

Extending radially outwardly from the peripheral edge of the flange member 20 are a plurality of knockout portions 25. The knockout portions 25 help ensure that the structural integrity of the reclosable attachment is not jeopardized during fabrication. The reclosable attachment 10 of the present invention is preferably manufactured in a mold from a suitable thermoplastic material. After the molding process is complete, it is necessary to remove the attachment 10 from the mold. However, the attachment 10 cannot be punched out of the mold in the normal fashion because such a punching action may cause damage to the bottom surface 23 of the flange member 20 which could adversely affect the structural integrity of the flange member 20 as well as the ability of the bottom surface 23 to be properly attached to the exterior surface of the container. Thus, in order to remove the attachment 10 from the mold while at the same time ensuring that the bottom surface 23 of the flange member 20 is not damaged, the knockout portions 25 are provided. A suitable device is provided in the mold to contact the knockout portions 25 upon completion of the molding process and thereby remove the attachment 10 from the mold.

The knockout portions 25 are spaced along the outer periphery of the flange member 20 at any desired locations. Preferably, the knockout portions 25 should be spaced somewhat evenly about the periphery of the flange member 20 so that the knockout force is distributed over the entire flange member 20. As can be seen in FIG. 1, the bottom surface of the knockout portions 25 is preferably axially spaced from the bottom surface 23 of the flange member 20 in order to ensure non-interference with the attachment of the reclosable attachment 10 to the container. Moreover, material costs are reduced as a result of the reduced thickness of the knockout portions 25. It is, of course, to be understood that the bottom surface of the knockout portions 25 can lie in the same plane as the bottom surface 23 of the flange member 20 (see FIGS. 6–10). The knockout portions 25 need only be as thick as is necessary to withstand the knockout force delivered by the aforementioned device.

Returning to FIG. 1, the cylindrical extension 24 has a length "C" as measured from the top surface 21 of the flange 20 that is substantially equal to the axial depth "D" of the depression or recess 30 in the cap 14 as measured from the bottom surface 31 of the cap 14 to the inner surface 32 of the depression 30. The depth "D" is also equal to the depth of the recess 13 into which fits the cylindrical extension 24, specifically the annular ridge 26. As a result, when the cap 14 is closed upon the cylindrical extension 24, the bottom end face 31 of the cap 14 essentially rests upon the top surface 21 of the flange 20. This construction reduces the overall height of the reclosable attachment 10. This reduced height improves the look of the reclosable attachment 10 and minimizes the chance that an accidental hitting of the reclosable attachment 10, for example during shipping, will either open the cap 14, or break or damage the cylindrical extension 24 or the seal of the cap 14. In one embodiment, the overall height of the reclosable attachment 10 is approximately 0.375 inches with the height of the flange member 20 being approximately 0.025 inches.

Moreover, the upper surface 21 of the flange member 20 acts as a stop in preventing the cap 14 from being pushed too far onto the cylindrical extension 24. Since there is a tendency on the part of some individuals to replace caps and tops on bottles and the like by pounding the caps and tops with their fist, the contact between the bottom surface 31 of the cap 14 and the top surface 21 of the flange 20 will help prevent the reclosable attachment 10, and more particularly, the liquid-tight and air-tight seal of the reclosable attachment 10 from becoming damaged as a result of such pounding.

Still referring to FIG. 1, it can be seen that the distance "X" which represents the perpendicular distance between the surface 46 of the portion 18' of connecting member 18 and an imaginary continuation of the bottom surface 23 of the flange portion 20 is substantially less than the distance "Y" which represents the perpendicular distance between the surface 46 of the portion 18" of connecting member 18 and the outer surface 48 at the top end of the cap 14. Thus, when the reclosable attachment 10 is laid out in a flat configuration so that the portions 18' and 18" of the connecting member 18 are coplanar, the bottom surface 23 of the flange member 20 is not coplanar with the outer surface 48 at the top end of the cap 14. That particular configuration is advantageous in that when the reclosable attachment 10 is attached to a container so that the bottom surface 23 of the flange portion 20 lies flat against the exterior surface of the container, it will not be possible when opening the cap 14 to pull the cap 14 all the way back (in the direction of arrow "A") so that the portions 18' and 18" of the connecting member are coplanar because the edge 50 of the cap 14 will contact the exterior surface of the container. Since the cap 14 cannot be opened to the full extent or beyond the full extent, the stress on the hinge 16 is reduced and thus, the life of the hinge 16 may be extended. Depending upon the particular contents of the container to which the reclosable attachment 10 is attached (e.g., if the contents are used in very small amounts), the cap 14 may be opened and closed numerous times in which case the ability of the hinge 16 to withstand repeated openings and closings is of importance.

With further reference to FIG. 1, the reclosable attachment 10 includes a cylindrically shaped stem 110 which is attached to and extends from the bottom surface 23 of the flange 20. The cylindrically shaped stem 110 is formed in one piece with the rest of the reclosable attachment. The stem 110 is hollow, has an interior surface 112 and is coaxially aligned with the cylindrical extension 24. As can be seen from FIG. 1, the axial length of the cylindrical stem 110 is substantially less than the axial length of the cylindrical extension 24. The inner diameter of the stem 110 is slightly smaller than the inner diameter of the cylindrical extension 24 and thus, positioned between the inner surface 22 of the cylindrical extension 24 and the inner surface 112 of the cylindrical stem 110 is a beveled intermediate inner surface 114. The beveled intermediate inner surface 114 provides a smooth transition between the inner surface 22 of the cylindrical extension 24 and the inner surface 112 of the cylindrical stem 110. In that way, the contents can flow smoothly out of the container. Of course, it is to be understood that the cylindrical extension 24 and the cylindrical stem 110 may have the same inner diameter, in which case the beveled intermediate inner surface 114 is unnecessary.

Figure 3:
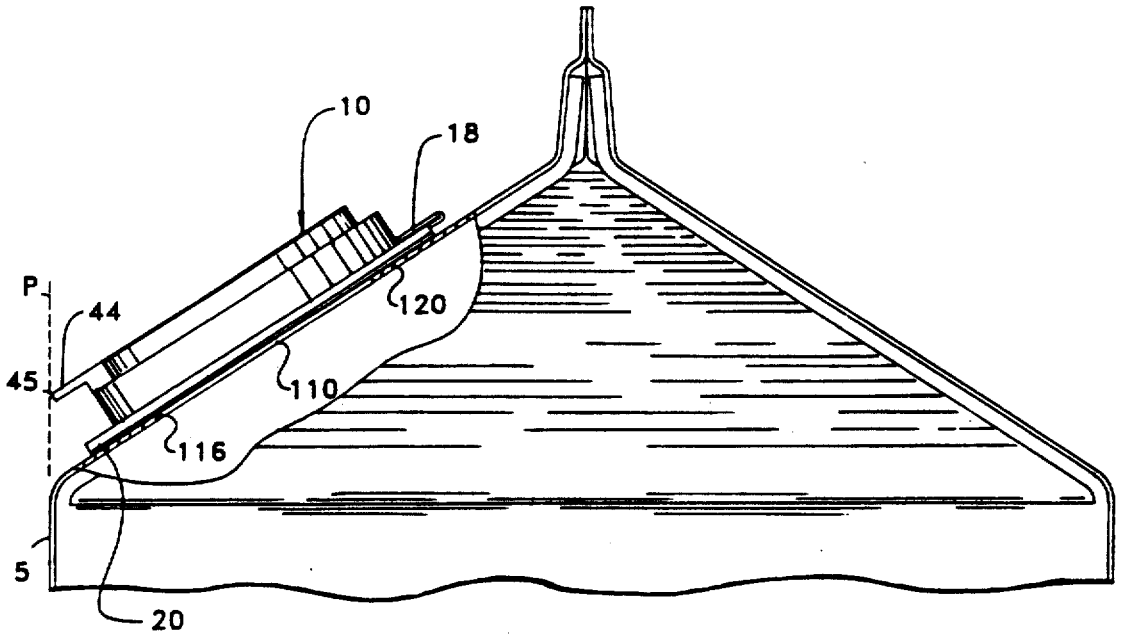
FIG. 3 is a side view, partially in cross-section, showing the reclosable attachment of FIG. 1 attached to an exemplary container.

As depicted in FIG. 3, the attachment 100 is mounted on the container by positioning the cylindrical stem 110 inside the hole 116 in the container wall. Preferably, the inner diameter of the hole 116 in the container wall is substantially equal to the outer diameter of the stem 110. In that way, the outer surface of the stem 110 will closely contact the inner periphery of the hole 116 in the container wall.

Although the foregoing description and the accompanying drawings show the outer surface of the stem 110 and the hole 116 in the container wall as being circular, it is to be understood that there may be situations where the use of a non-circularly shaped stem 110 and hole 116 may be desirable. Similarly, it may be desirable to utilize an extension 24 that is other than cylindrically shaped.

Figure 4:
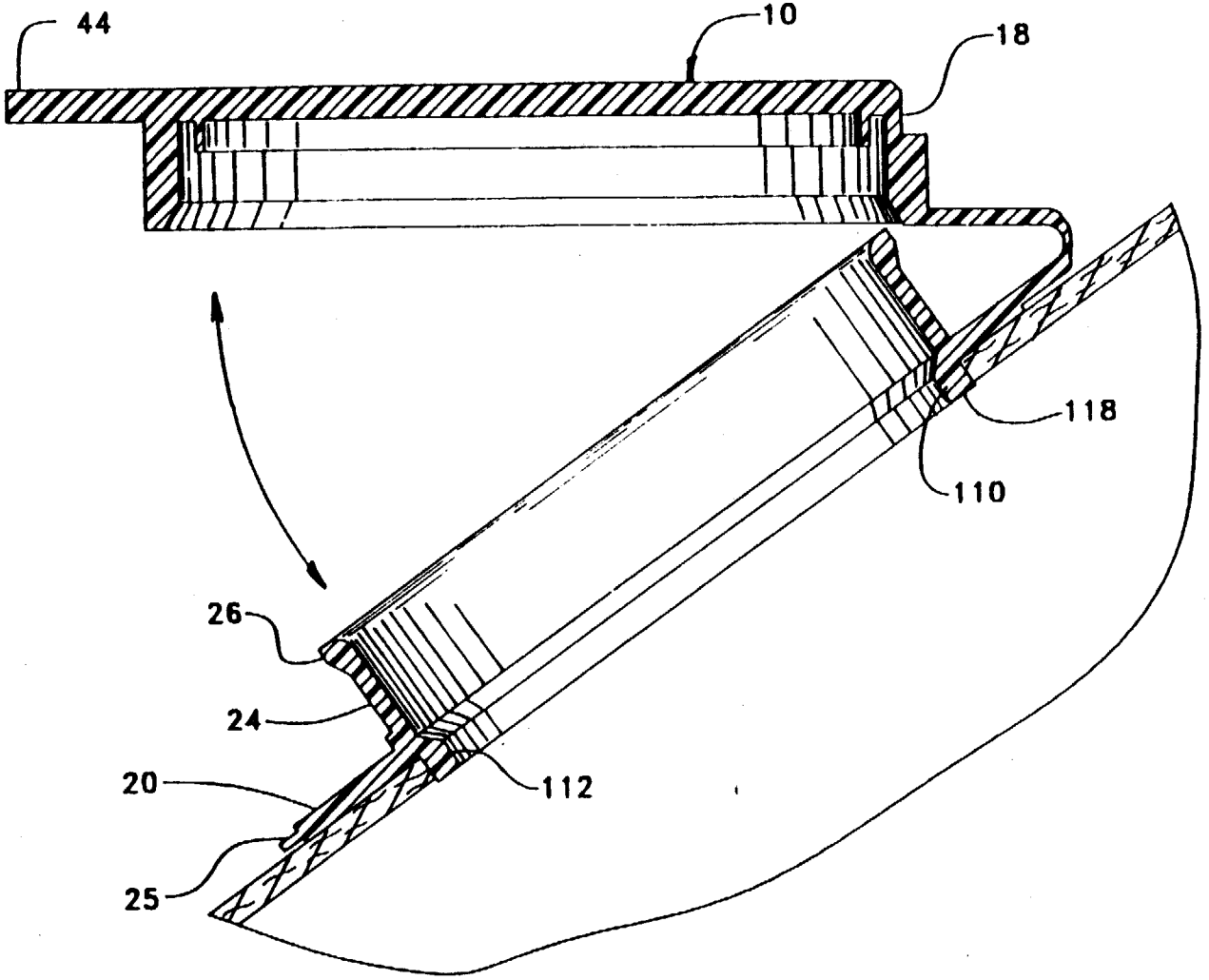
FIG. 4 is an enlarged view of FIG. 3 showing, in cross-section, the reclosable attachment of FIG. 1 partially open and attached to a container.

As seen in FIG. 3 and more closely in the enlarged view of FIG. 4, the length of the cylindrical stem 110 (i.e., the extent to which the stem 110 extends away from the bottom surface 23 of the flange as designated by the distance "Z" in FIG. 1) is substantially equal to the thickness of the container wall to which the attachment 100 is attached. In that way, the free end 118 of the stem 110 will be substantially flush with the inner surface 120 of the container wall on which the attachment 100 is mounted. Since the thickness of container walls varies from container to container, the reclosable attachment 100 can be readily designed and adapted to meet the requirements of each different container by coordinating the length of the stem 110 with the thickness of the container wall.

While it may be desirable in certain instances to dimension the stem 110 such that its axial length is greater than the thickness of the container wall, whereby the end of the stem 110 extends beyond the inner surface of the container wall, the preferred construction in this embodiment is to dimension the stem 110 to be substantially flush with the inner surface 120 of the container wall. Dimensioning the stem 110 so that its length is substantially equal to the container wall thickness is preferable because material costs associated with the stem 110 can be kept at a minimum yet the stem 110 will be able to perform its intended function the description of which will be set forth below.

FIG. 2 shows a bottom plan view of the reclosable attachment 10 and illustrates the manner in which the cylindrically shaped stem 110 extends axially from the bottom end face 23 of the flange 20.

In view of its rather simple construction, the reclosable attachment 10 can be formed in one piece in a mold. Thus, there is no need to fabricate numerous parts which are later assembled nor is there a need to carry out a plurality of molding operations. A single mold and molding process is all that is needed to fabricate the reclosable attachment 10.

Figure 11:
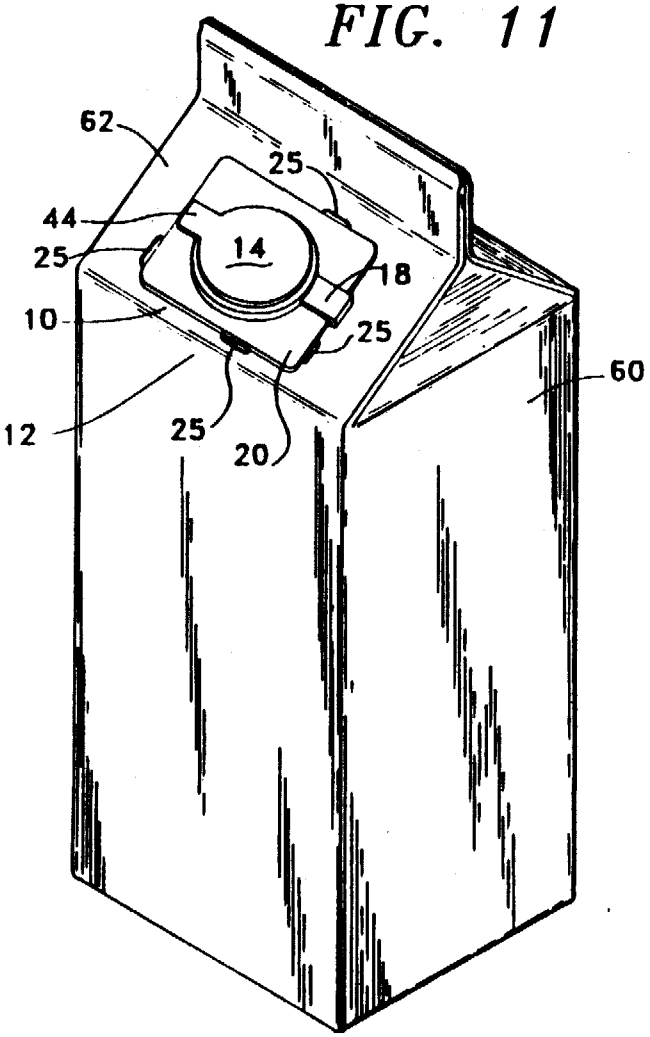
FIG. 11 is a perspective view of one type of container showing the reclosable attachment of the present invention secured thereto.

Turning to FIG. 11, the reclosable attachment 10 is shown attached to a container 60. Although the container illustrated is a gable top type container, such as, for example, a milk or juice carton, it is to be understood that the container to which the attachment 10 is secured can be any type of container and is not to be limited to the container illustrated in any of the figures.

Figure 14:
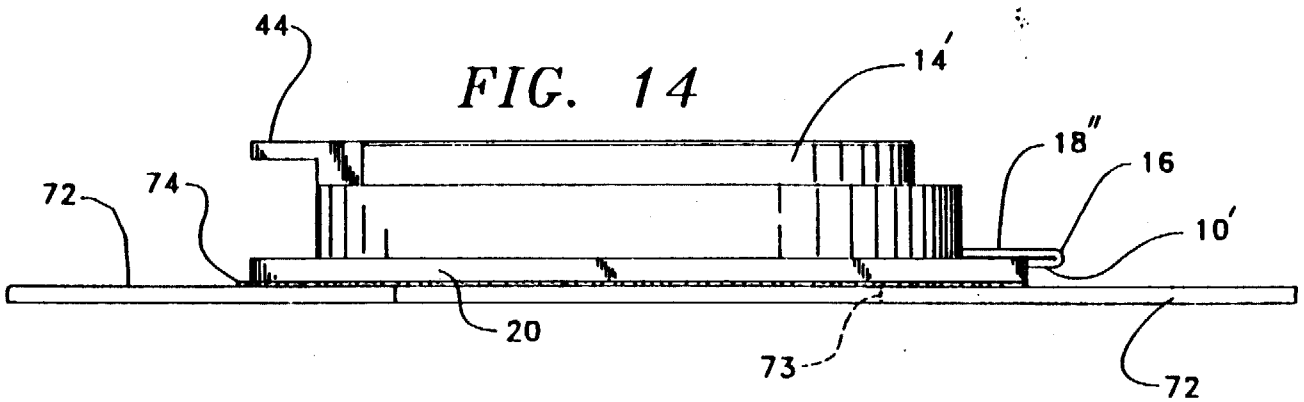
FIG. 14 is a side view of the reclosable attachment of FIG. 1 secured to the side wall of a container.

The reclosable attachment 10 illustrated in FIG. 1 may be secured to the side of a container in a variety of ways. For example, a pressure sensitive adhesive, a heat and pressure seal, sonic welding, or a hot melt may be used to secure the reclosable attachment 10. Also, the plastic from which the attachment 10 is manufactured can be fused to the wall of the container. In addition, to help ensure that the bottom surface 23 of the flange member 20 is strongly secured to the outer surface of the container, the bottom surface 23 of the flange member 20 may be chemically etched. In that way, the surface area on the bottom surface 23 of the flange member 20 can be increased. FIG. 14 shows the attachment 10 secured to the exterior surface 70 of a wall 72 of a container and shows the bonding 74 area between the bottom surface of the reclosable attachment and the exterior surface of the container.

One of the advantages associated with the reclosable attachment 10 described above is that the attachment 10 can be readily attached to any portion of the container. The container manufacturer can fabricate the container in flat blanks with or without the hole for receiving the reclosable attachment formed therein. The blanks can be sent to a separate processing facility where the hole is formed, if necessary, and the reclosable attachment is applied to the container in the manner described below. The container can then be filled in the normal way, sealed and sent to a wholesaler or retailer for storage or sale. In view of the ease with which the reclosable attachment of the present invention can be attached to the container, the process of attaching the reclosable attachment to the container can be performed on-line with the container forming and filling process. By simply modifying a processing facility through the addition of an appropriate apparatus that is capable of forming the hole 116 in the container and applying the reclosable attachment to the container, container blanks supplied from the container manufacturer can be processed in the normal way, thereby producing filled containers with the reclosable attachment secured thereto. Thus, from a manufacturing point of view, the reclosable attachment of the present invention is quite desirable because neither the container manufacturer nor the producer of the contents that are placed in the container need to significantly modify their manufacturing processes to accommodate the reclosable attachment. Of course, for purposes of quality assurance, the formation of the hole in the container blank and the securement of the reclosable attachment to the container blank can be performed off-line. In that way, the container blanks can be inspected prior to folding and filling to thereby ensure that the reclosable attachments have been secured to the container in a liquid-tight and air-tight manner.

As mentioned previously, the reclosable attachment 10 according to the present invention is attached to the container by any suitable means such as, for example, the use of sonic welding, chemical bonding, heat and pressure, or the application of a pressure sensitive adhesive or other suitable adhesive between the bottom surface 23 of the flange member 20 and the portion of the exterior surface of the container to which the attachment 10 is to be secured. The securement of the reclosable attachment 10 to the container can be relatively easily accomplished. Attaching the reclosable attachment 10 to the container through the application of heat and pressure offers certain advantages over other methods such as, for example, sonic welding due to the fact that the plastic from which the reclosable attachment is fabricated and the plastic coating on the container have different melting points. Through the use of a heat and pressure type of attachment, the coating on the container and the bottom surface of the reclosable attachment can be separately heated to the extent necessary to cause softening and then the reclosable attachment 10 can be brought into engagement with and pressed against the container with the stem 110 extending from the flange 20 located in the hole 116 in the container. However, if a suitable adhesive is used, such an adhesive bond may be the simplest form of attachment.

Advantageously, the reclosable attachment 10 can be placed anywhere on the exterior surface of the container that one desires. Other than providing a hole in the container into which the stem 110 can be positioned, the container need not be specially adapted to accommodate the reclosable attachment 10. Thus, there is little additional cost associated with manufacturing the container to accommodate the reclosable attachment 10. Further, there is no need to provide complicated changes to the container in order to accommodate the attachment of the reclosable attachment 10 to the container.

Another advantage associated with the reclosable attachment 10 according to the present invention concerns the cylindrical extension 24 that extends from the flange member 20. When the flange member 20 is attached to a container, the cylindrical extension 24 acts as a pour spout for directing the flow of the container's contents. Thus, the attachment 10 of the present invention is able to avoid spillage, dripping and uncontrollable flow of the container's contents.

The manner in which the cap 14 closes upon the cylindrical extension 24 provides another advantage associated with the reclosable attachment 10 of the present invention. Assuming, for example, that the container contains liquid, after the liquid has been poured from the container through the cylindrical extension 24, some residual liquid will remain on the inner surface of the cylindrical extension 24. Over time, that residual liquid will become sticky and tacky. Since the cap 14 of the present invention is designed to fit around the exterior surface of the cylindrical extension 24 rather than inside the cylindrical extension, the sticky and tacky residual liquid on the inner surface of the cylindrical extension 24 does not inhibit subsequent openings of the cap 14.

Figure 12:
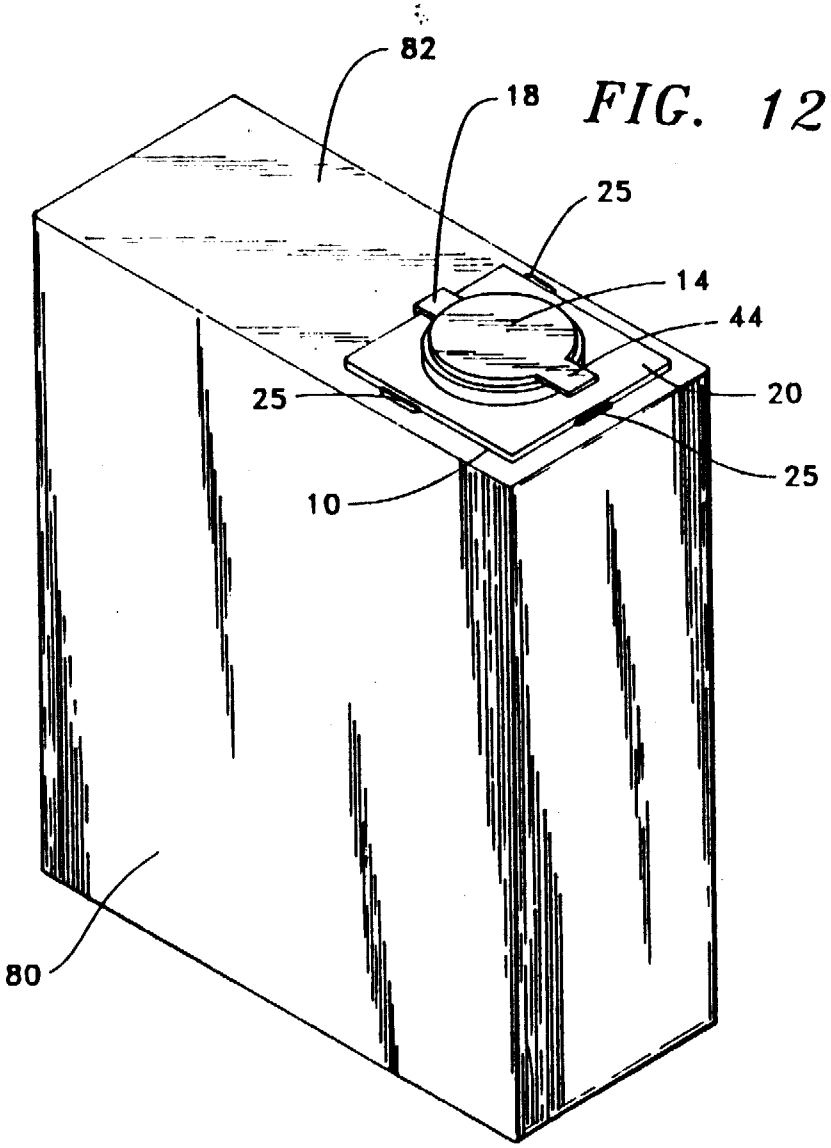
FIG. 12 is a perspective view of another container showing the reclosable attachment of the present invention secured thereto.

The reclosable attachment 10 of the present invention is shown in FIG. 12 as being attached to a top wall 82 of a container 80. A comparison of FIGS. 11 and 12 illustrates the fact that the reclosable attachment lo of the present invention can be attached to any type of container and on any portion of a container.

Figure 13:
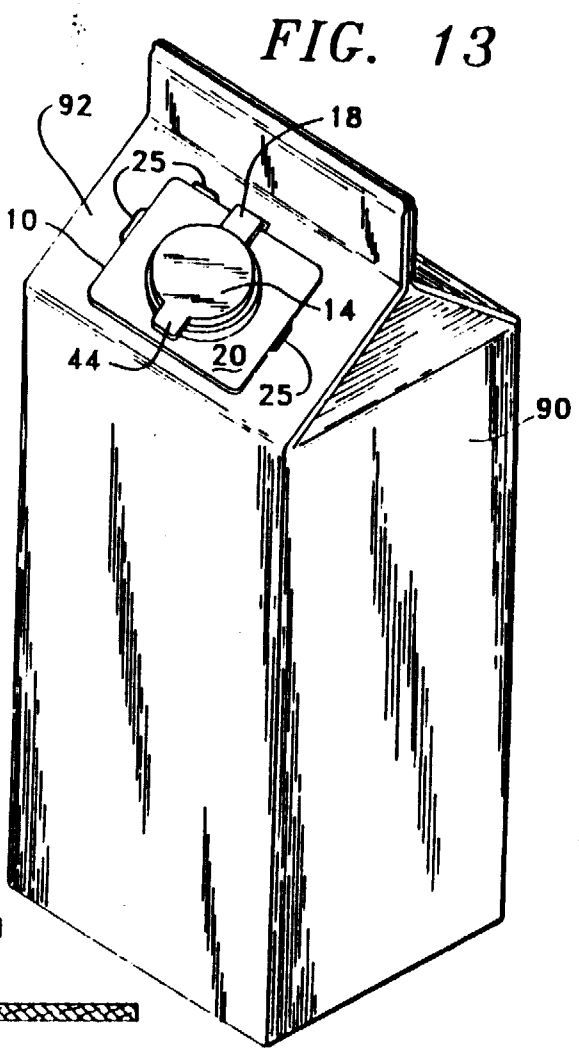
FIG. 13 is a perspective view of the container illustrated in FIG. 11, showing the reclosable attachment mounted in a different orientation with respect to the container.

It is also possible to orient the reclosable attachment 10 on a container in any manner desired. In that regard, FIG. 13 shows the reclosable attachment 10 attached to a container 90 that is similar to the container 60 depicted in FIG. 11. However, in the embodiment of FIG. 13, the reclosable attachment 10 has been rotated ninety degrees in the counter-clockwise direction with respect to the position shown in FIG. 11. Thus, while the attachment 10 shown in FIG. 11 will open to the right, the attachment 10 shown in FIG. 13 will open to the top. It is evident, therefore, that the attachment 10 can be oriented on a container so that the cover 14 opens to one side or the other or alternatively, so that the cover 14 opens to the top or bottom.

The reclosable attachment device 10 can be manufactured from thermoplastic material or any other type of material suitable for providing proper operation of the reclosable attachment. One consideration in choosing an appropriate material may be the governmental regulations relating to the specific types of materials contained in the container. For example, if the container contains milk, FDA regulations may prohibit the use of certain materials or may state that only certain materials may be used.

The finger tab 44 should preferably extend radially outwardly from the top edge of the cap 14 a distance sufficient to ensure that the end 45 of the finger tab 44 is accessible. Preferably, when the reclosable attachment is attached to the container in the manner illustrated in FIGS. 3, 12, and 13, the reclosable attachment 10 should be mounted with respect to the container such that the end 45 of the finger tab 44 extends beyond the plane of the container side wall towards which the finger tab 44 extends. Thus, referring to FIG. 3 for example, the reclosable attachment 10 should be attached to the container such that the end 45 of the finger tab 44 extends beyond the plane P in which lies the container side wall S towards which the finger tab 44 extends. That attachment and arrangement of the finger tab 44 ensures that the finger tab 44 will be readily accessible for opening the cap 14. To open the cap 14, a user need only move their finger upwardly along the container side wall S, whereupon their finger will contact the end 45 of the finger tab 44 and thereby flip the cap 14 upwardly.

The use of a reclosable attachment 10 in which the cylindrical stem 110 extends from the bottom surface 23 of the flange member 20 also presents several advantages. First, the stem 110 may serve as a locating means for positioning the reclosable attachment 10 in accurate alignment with the hole in the container wall. In the absence of the cylindrical stem 110, great care must be taken in ensuring that the through hole in the cylindrical extension 24 is accurately aligned with hole in the container. Otherwise, uneven and erratic flow of the contents out of the container may occur if the reclosable attachment and the hole in the container are not correctly aligned. The particular construction of the reclosable attachment 10 overcomes that difficulty, however, because the stem 110 permits the proper position of the reclosable attachment relative to the container to be quickly and easily ascertained as a result of the fact that the stem 110 extends into the hole in the container side wall. The ability of the stem 110 to serve as a locating means for properly positioning the reclosable attachment is useful regardless of whether the reclosable attachment 10 is secured to the container manually or mechanically.

The cylindrical stem 110 also serves another useful purpose in that it helps to prevent wicking, thereby maintaining the structural integrity of the container. When a hole is formed in the container side wall through which the contents of the container are to be emptied, the internal layer(s) of the material from which the container is manufactured is exposed at the hole periphery. During transportation and handling of the container, the contents of the container, for example a liquid, will repeatedly come into contact with the material of the container that is exposed at the periphery of the hole. During storage, the filled containers may even be placed on their sides, in which case the liquid contents will remain in continuous contact with the container material exposed at the hole periphery. Further, when portions of the liquid contents are emptied from the container by the consumer, the liquid contents will contact the container material exposed at the hole periphery. Depending upon the composition of the material from which the container is manufactured, the specific type of liquid contents in the container, and the length of time that the liquid contents is in contact with the container material, certain problems may arise. For example, as a result of wicking, the container material may become partially saturated at areas surrounding the hole periphery and that may adversely affect the structural integrity of the container material at those areas. If the container material actually begins to fall apart as a result of becoming saturated, the connection between the reclosable attachment and the container may be adversely affected. Moreover, problems may arise with respect to contamination of the liquid contents.

The reclosable attachment 10 according to the present invention, however, is able to overcome those potential problems. Since the cylindrical stem 110 is positioned in the hole in the container, the container material exposed at the hole periphery is surrounded by the cylindrical stem 110. The outer diameter of the cylindrical stem is substantially equal to the inner diameter of the hole in the container wall and thus, the outer surface of the cylindrical stem 110 closely contacts and tightly engages the inner periphery of the hole in the container wall. In that way, the cylindrical stem 110 substantially prevents the liquid contents from contacting the container material exposed at the periphery of the hole in the container wall.

It may also be desirable to apply a suitable sealant such as wax or a plastic material to the inner periphery of the hole 116 in the container to further insulate the material of the container from the adverse affects that might occur as a result of wicking.

An especially advantageous manner for ensuring that the material of the container that is exposed at the inner periphery of the hole 116 is insulated from the potentially adverse affects that might occur as a result of wicking involves flaring the end of the stem 110 outwardly against the inner periphery of the hole 1. During installation of the stem 110 in the hole 116 in the container blank, the stem 110 can be heated to a temperature sufficient to cause softening and a tool having a tapered shape can then be inserted into the stem 110 from the free end 118 side of the stem 110. The tapering shape of the tool will force the softened stem 110 outwardly and cause the outer periphery of the stem 110 to tightly engage the inner periphery of the hole 116 in the container, thereby preventing the liquid or other contents that are later placed in the container from contacting the container material that is exposed at the inner periphery of the hole 1.

If the reclosable attachment is attached to the container by the heat and pressure method described above, the heating o the bottom surface of the reclosable attachment for purposes of securing the reclosable attachment to the container can be carried out to an extent sufficient to soften the stem 110. In that way, the aforementioned process of forcing the stem 110 outwardly through use of a tapering tool can be performed without the need for separately heating and softening the stem 110. A heated tapering tool can also be used to initially soften the stem 110 or to ensure that the stem 110 remains softened.

Another possible way in which the material of the container exposed at the inner periphery of the hole 116 can be insulated from the potentially adverse affects of wicking is to utilize a stem 110 having an axial length that is greater than the thickness of the container. In that case, the stem 110 could once again be heated and softened. Upon insertion into the hole 116 in the container blank, the softened stem could then be forced outwardly by an appropriate tool placed on the free end 118 side of the stem 110 so that the stem 110 wraps around the inner periphery of the hole while the free end 118 of the stem 110 is brought into engagement with the inner surface of the container blank. By wrapping the stem 110 around the inner periphery of the hole 116 and bringing the free end of the stem 110 into engagement with the surface of the container blank that will form the inner surface of the container when the container blank is formed into a folded container the container material that is exposed at the inner periphery of the hole 116 is effectively sealed from the liquid or other contents that is later placed in the container.

In order to facilitate the insertion of the attachment into the hole in the container, the outer periphery of the stem 110 can tapered inwardly slightly.

Figure 5:
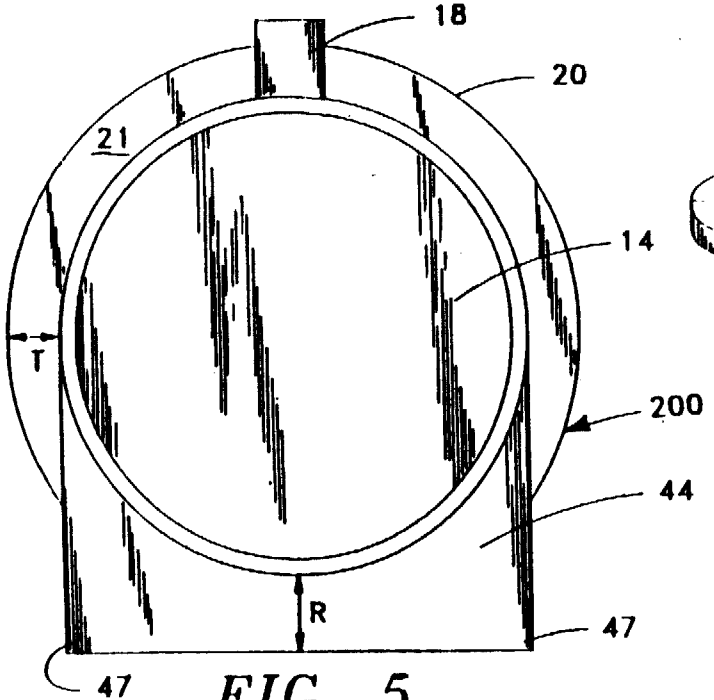
FIG. 5 is a top view of a reclosable attachment according to a second embodiment of the present invention with the cap in the closed position.

A second embodiment of the reclosable attachment of the present invention is illustrated in FIG. 5. The reclosable attachment 200 according to the second embodiment includes a circular flange 20 rather than the rectangularly shaped flange 20 shown in, for example, FIGS. 11, 12 and 13. The use of a reclosable attachment having a circular flange may be desirable if the attachment is to be attached to a surface on a container that is also circular. In that way, the circular flange can be placed closer to the curved edge of the container wall to which the reclosable attachment is to be attached than would be the case if the flange were rectangularly shaped.

The reclosable attachment 200 shown in FIG. 5 also includes an enlarged finger tab 44 that is wider than the finger tabs 44 shown in the previous embodiments. The increased width makes it easier to manipulate the cap 14 from the closed position to the open position. As illustrated in FIG. 5, the width of the finger tab 44 is substantially equal to the outer diameter of the cap 14. Of course, the width of the finger tab 44 need not be increased to the extent shown in FIG. 5.

In addition to the aforementioned advantages associated with the individual use of the circular flange 20 and the rectangular finger tab 44 of increased width, there are certain synergistic advantages associated with the use of those two features together. For example, the rectangular shape of the finger tab 44 and the circular shape of the flange 20 causes corner portions 47 of the finger tab 44 to extend out beyond the peripheral edge of the flange 20. Thus, even though the distance which the finger tab 44 extends outwardly from the peripheral edge of the cap 14 (as represented by the distance "R" in FIG. 5) may not be greater than the amount by which the flange 20 exceeds the size of the cap 14 (as represented by the distance "T" in FIG. 5), the corner portions 47 of the finger tab 44 will extend beyond the outer periphery of the flange 20 and will thereby be easily accessible. In particular, by having the corner portions 47 positioned outside the flange 20, the available distance for accessing release tab 44 is increased by the thickness of the flange 20.

If the contents of the container to which the reclosable attachments described above are to be applied are products that are to be consumed, a special concern arises with respect to being able to ascertain whether the container has been tampered with prior to purchasing and whether the contents in the container have been contaminated or adulterated. Also, because the containers with the reclosable attachment secured thereto will be shipped and extensively handled prior to being purchased by the ultimate consumer, the possibility exists that the cap 14 on the reclosable attachment will be accidentally opened. In view of those concerns, the reclosable attachment of the present invention is designed with a feature that substantially prevents the accidental opening of the cap 14 and that also provides evidence that the reclosable attachment has been tampered with.

Figure 6:
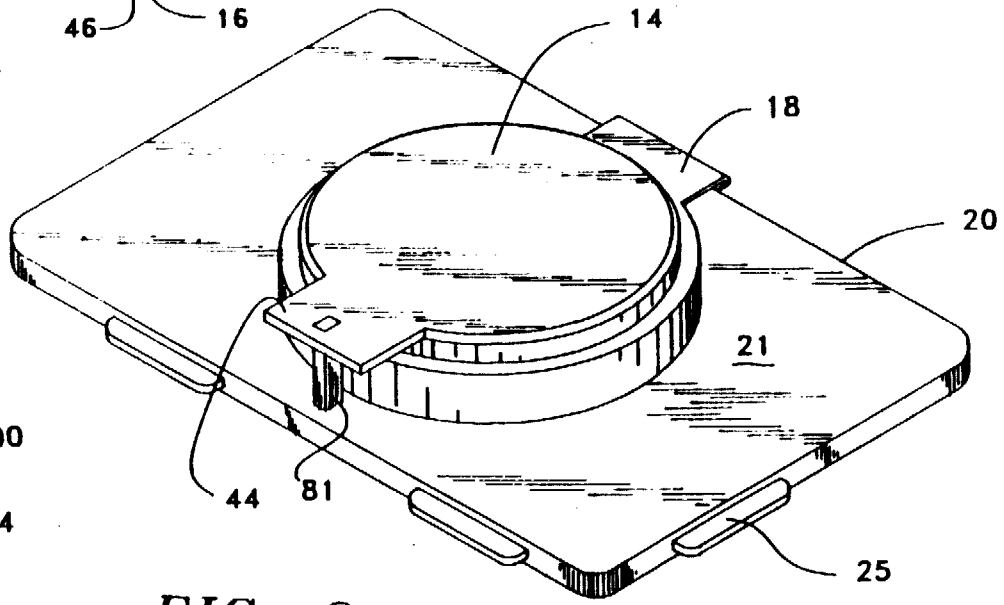
FIG. 6 is a perspective view of the reclosable attachment showing a first embodiment of the tamper evident and accidental opening preventive feature according to the present invention.

Turning to FIGS. 6–10, five embodiments of the tamper evident and accidental opening preventive feature of the present invention will be described. In FIG. 6, the tamper evident and accidental opening preventive feature includes a post 81. One end of the post 81 is formed integrally and in one piece with the top surface 21 of the flange 20 while the other end extends through a hole in the finger tab 44 and is bead welded, or secured by other suitable means to the finger tab 44.

Figure 7:
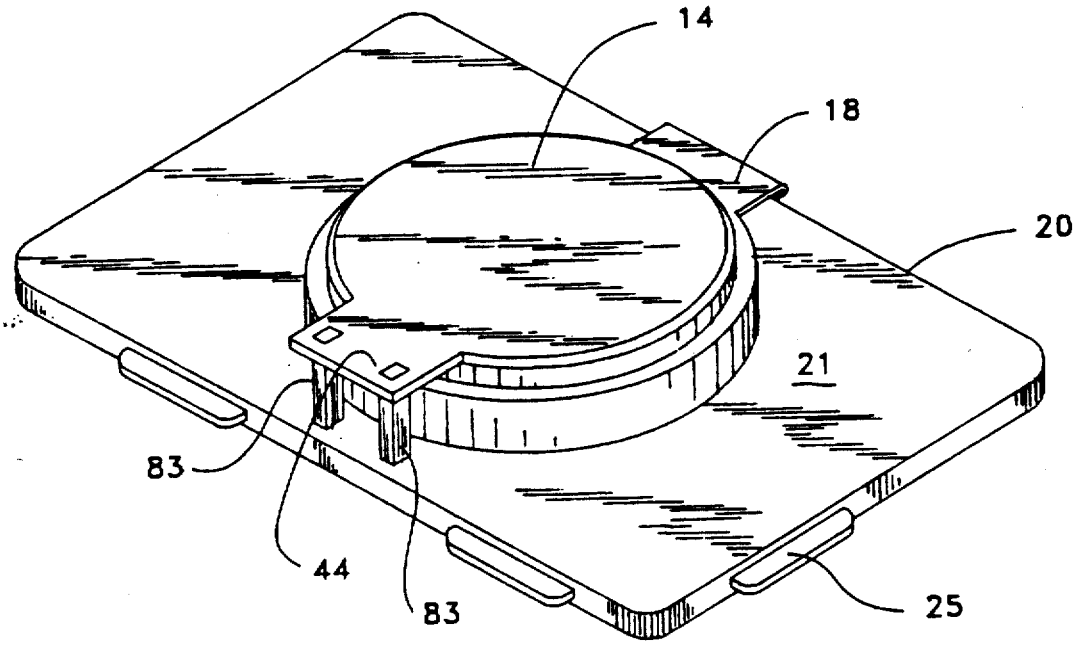
FIG. 7 is a perspective view of the reclosable attachment showing a second embodiment of the tamper evident and accidental opening preventive feature according to the present invention.

The embodiment illustrated in FIG. 7 is similar to the embodiment shown in FIG. 6 except that in the FIG. 7 embodiment, two posts 83, 83 are provided. In the embodiments of the tamper evident and accidental opening preventive feature illustrated in FIGS. 6 and 7, the posts 81, 83 can be bead welded to the top surface 21 of the flange 20 and integrally formed in one piece with the underside of the finger tab 44. Alternatively, both ends of the posts 81, 83 may be bead welded to their respective areas on the flange 20 or the finger tab 44.

Figure 8:
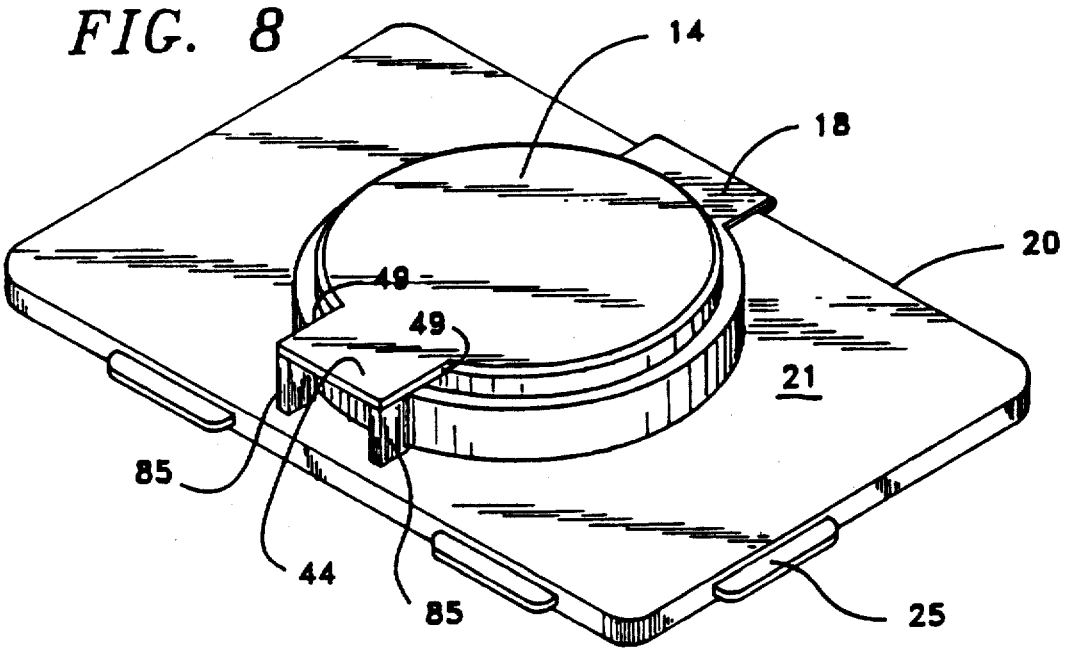
FIG. 8 is a perspective view of the reclosable attachment showing a third embodiment of the tamper evident and accidental opening preventive feature according to the present invention.

The embodiment illustrated in FIG. 8, includes two posts 85, each of which is formed in one piece with the top surface 21 of the flange 20 and each of which is bead welded to one peripheral edge 49 of the finger tab 44. The top of the two posts 85 is substantially coplanar with the upper surface of the finger tab 44. As noted above, both ends of both posts 85 may be bead welded in their respective positions or alternatively, the one end of each of the posts 85 may be formed integrally with the finger tab 4 while the other end is bead welded to the top surface 21 of the flange 20.

Figure 9:
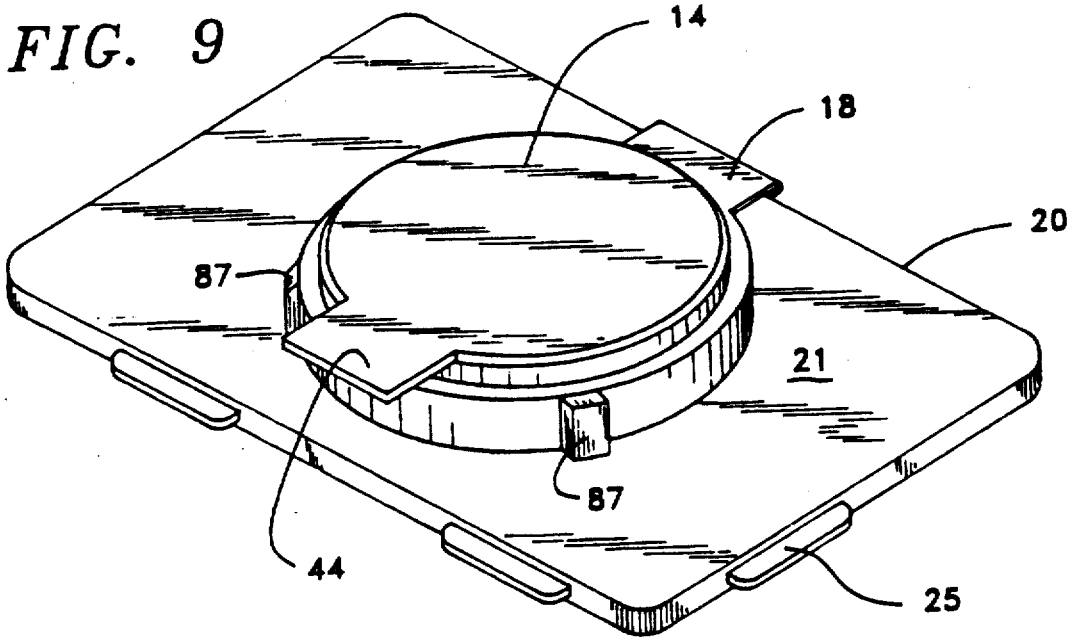
FIG. 9 is a perspective view of the reclosable attachment showing a fourth embodiment of the tamper evident and accidental opening preventive feature according to the present invention.

The fourth embodiment shown in FIG. 9, includes a plurality of blocks 87 which are formed in one piece with the outer peripheral surface of the cap 14 and which are bead welded to the top surface 21 of the flange 20. Alternatively, the blocks 87 could be bead welded to the outer periphery of the cap and formed integrally with the top surface 21 of the flange. However, when the blocks 87 are integrally formed in one piece with the cap 14, upon opening of the cap 14, the bead welded connection will break and the blocks 87 will move with the cap 14. By bead welding the blocks 87 to the top surface 21 of the flange 20, the blocks 87 will be carried on the cap 14 during opening and closing of the cap 14 and thus, will not interfere with the operation of the cap 14. Whereas, if the blocks 87 are fixed on the flange 20, they may interfere with subsequent closings of the cap 14. If desired, more than two blocks can be provided.

Figure 10:
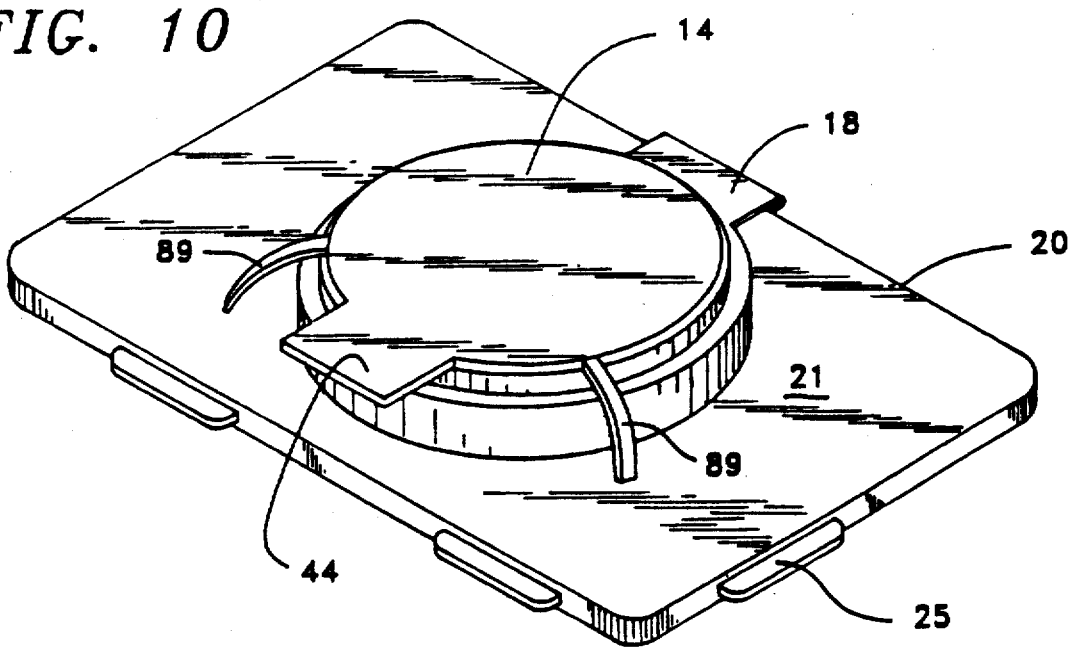
FIG. 10 is a perspective view of the reclosable attachment showing a fifth embodiment of the tamper evident and accidental opening preventive feature according to the present invention.

The fifth embodiment of the tamper evident and accidental opening preventive feature is depicted in FIG. 10 and includes two elongated connecting arms 89 that extend between the top surface 21 of the flange 20 and the upper surface or upper edge of the cap 14. Preferably, one end of the connecting arms 89 is bead welded to the upper surface 21 of the flange 20 while the other end of each arm 87 is formed in one piece with the upper edge or upper surface of the cap 14. For reasons similar to those noted above with respect to the embodiment shown in FIG. 9, although it is possible to bead weld the one end of the arms 89 to the cap 14 while forming the other end of the arms 89 in one piece with the upper surface 21 of the flange 20, it is preferable that the arms be bead welded to the flange 20 and formed integrally with the cap 14. Of course, if desired, more than two arms 87 may be provided.

As a result of the constructions depicted in FIGS. 6–10, the cap 14 is securely connected to the flange member 20 and thus, cannot be accidentally opened during shipping and handling. The bead weld connections described above are strong enough to ensure that when the release tab 44 is inadvertently bumped or contacted, the cap 14 will not accidentally open. On the other hand, when one wishes to open the cap 14 for pouring the contents from the container, the bead weld connections can be broke without great difficulty.

During use, when the cap 14 is opened for the first time, the bead welded connection will break and thereby permit the cap to be subsequently opened and closed. Each of the embodiments of the tamper evident and accidental opening preventive feature, therefore, allow the consumer to immediately determine whether the reclosable attachment has been tampered with by merely determining whether any of the bead welds have been broken. Thus, the contents of the container cannot be unknowingly contaminated or adulterated through the reclosable attachment. Further, the accidental opening preventive feature provides additional protection against the possibility that the cap 14 will be accidentally opened during handling and shipping of the containers.

As noted, one end of each of the posts 81, 83, 85, 87 and the arms 89 defining the tamper evident feature of the present invention is preferably formed integrally and in one piece with either the cap 14 or the top surface 21 of the flange 20. No additional molding or forming steps are required to fabricate the posts 81, 83,85, 87 and arms 89 and little additional cost is incurred in the fabrication of those parts. As a result, the reclosable attachment of the present invention can be quickly, easily and rather inexpensively provided with a tamper evident feature. The tamper evident feature of the present invention can be utilized in conjunction with both embodiments of the reclosable attachment described above and shown in the drawings.

Turning now to FIGS. 15–19, a third embodiment of the reclosable attachment 300 of the present invention will be described. For purposes of simplicity and in order to avoid duplication and redundancy, those portions of the reclosable attachment 300 according to the third embodiment that are the same as those in the first embodiment are labelled with the same reference numerals and a description of those features is not repeated, except as is necessary for a complete understanding of the invention.

Figure 17:
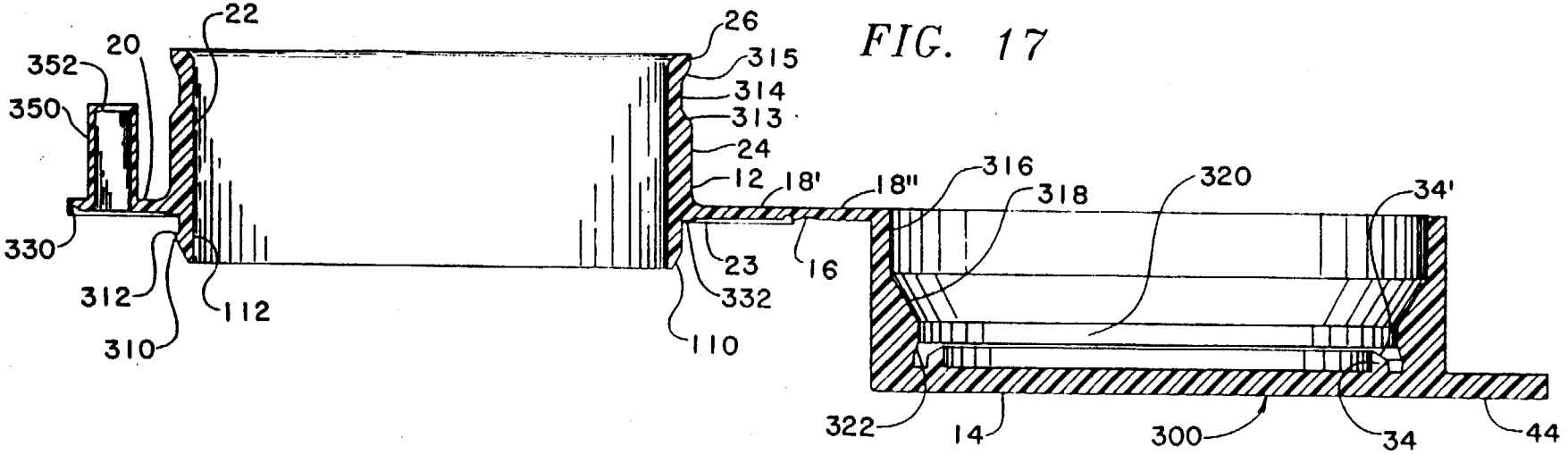
FIG. 17 is a cross-sectional view of the third embodiment of the reclosable attachment along the section line 17—17 in FIG. 16.

With reference initially to FIG. 17, the reclosable attachment 300 according to the third embodiment includes a cylindrically shaped stem 110 which is attached to and extends from the bottom surface 23 of the flange member 20. The cylindrical extension 110 is integrally formed in one piece with the remainder of the reclosable attachment 300.

As seen in FIG. 17, the inner diameter of the stem 110, the inner diameter of the flange member 20 and the inner diameter of the extension 24 are substantially equal, thereby defining a smooth cylindrical inner surface for the base member 12.

Figure 15:
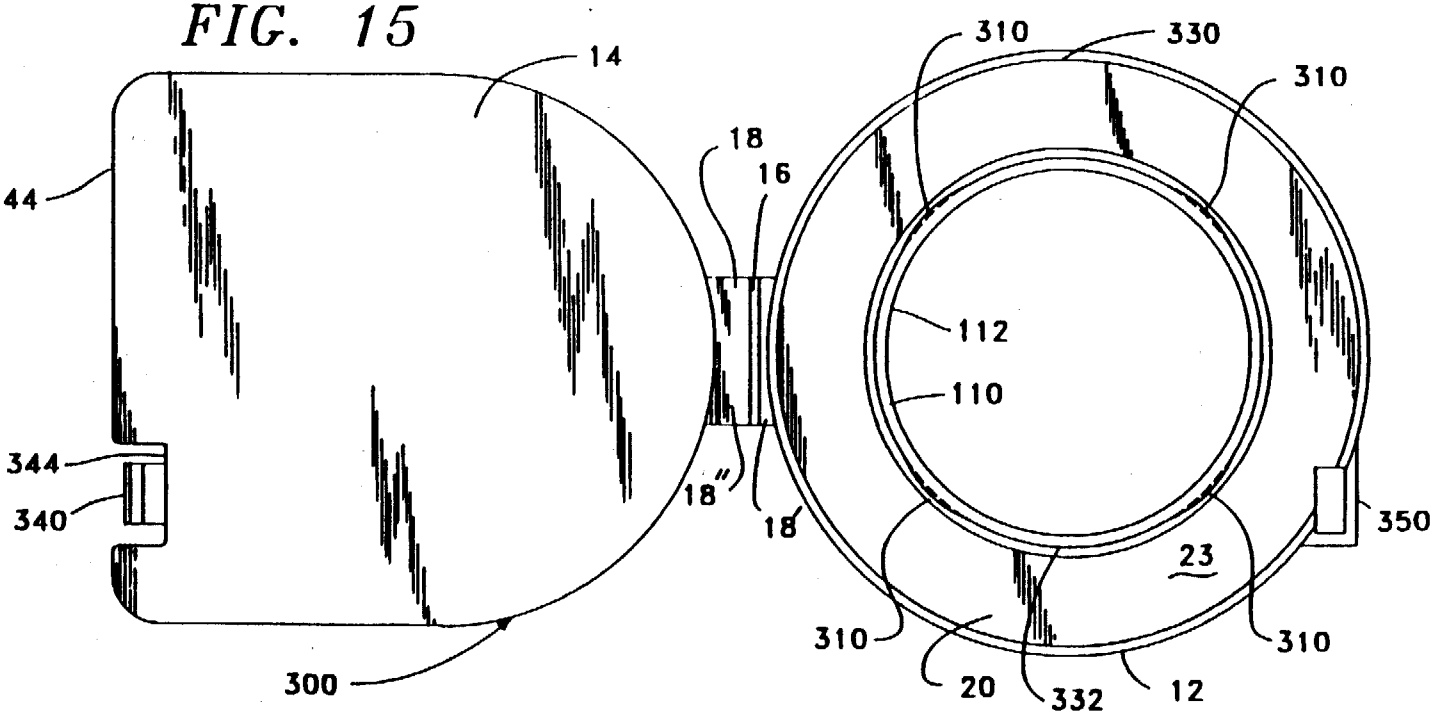
FIG. 15 is a bottom plan view of the reclosable attachment according to a third embodiment of the present invention.

With reference to FIG. 15, the cylindrical stem 110 is provided with four spaced apart ledges 310 that extend radially outwardly from the outer peripheral surface of the stem 110. Each ledge 31 preferably extends along the outer periphery of the stem 110 over an arc of approximately 45°. Thus, corresponding portions of adjacent ledges 310 are spaced apart from one another approximately 90°. While the preferred embodiment includes four ledges 310 that are spaced apart from on another by equal arcs, it is to be understood that more or less than four ledges can be provided and the ledges can be spaced apart by different amounts. Also, the ledges can extend around the outer periphery of the stem for an amount more or less than the 45° arc mentioned above. For reasons that will become apparent hereinafter, it is preferable that several spaced apart ledges 310 be provided rather than one continuous ledge.

With reference to FIG. 17, it can be seen that the ledges 310 extend over only a portion of the axial length of the stem 110 s that the ledges 310 are spaced from the bottom surface 118 of the stem 110 and the bottom surface 23 of the flange member 20. The ledges 310 ar preferably spaced from the bottom surface 23 of the flange member 20 by a distance that substantially corresponds to the thickness of the container wall on which the attachment 300 is to be mounted.

Figure 19:
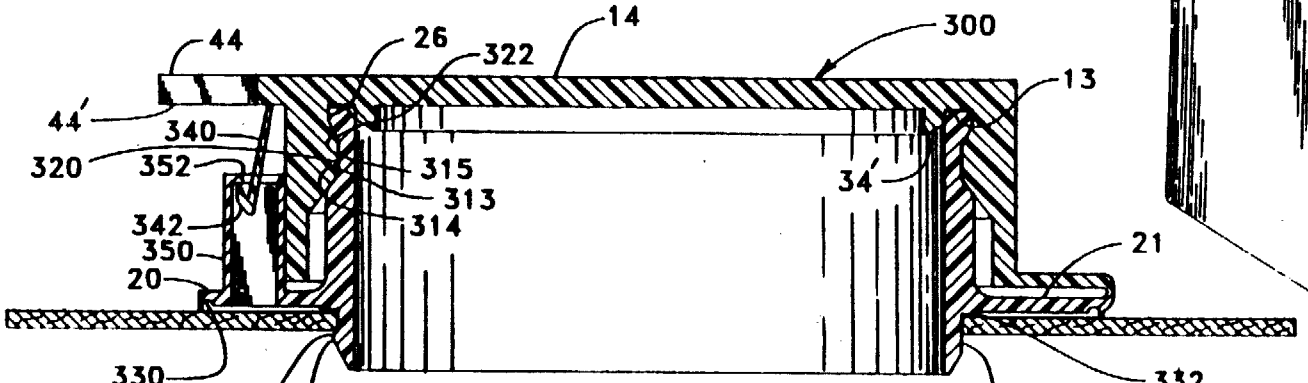
FIG. 19 is a cross-sectional view of the reclosable attachment according to the third embodiment illustrating the attachment mounted on a container with the cap in the closed position.

The ledges 310 serve the advantageous function of helping to maintain the position of the reclosable attachment 300 on the container to ensure that the attachment 300 is securely attached to the container. When the reclosable attachment 300 is mounted on the container, the stem 110 is inserted into the hole in the container. Due to the nature of the container material, the periphery of the hole in the container may be displaced slightly in the plane of the material when the stem 110 is inserted into the hole. The portion of the container wall surrounding the stem 110 becomes positioned between the ledges 310 and the bottom surface 23 of the flange member 20 as seen in FIG. 19. Thus, the reclosable attachment 300 is held in place relative to the container in the axial direction so that the attachment 300 can be securely attached to the container by suitable means. The inclined edges 312 of the ledges 310 also help maintain the position of the reclosable attachment 300 in the lateral direction relative to the container. Absent the ledges 310, the position of the reclosable attachment 300 could move during securement, thereby adversely affecting the seal between the attachment 300 and the container. To further facilitate maintaining the reclosable attachment 300 in place relative to the container, it may be desirable to rotate the reclosable attachment 300 slightly after the stem 110 is pushed through the hole in the container.

The stem 110 is shown as extending straight downwardly from the bottom surface 23 of the flange member 20. However, it may be desirable to inwardly taper the outer peripheral surface of the stem 110 at its free end in order to facilitate insertion of the stem 110 into the hole in the container.

As seen in FIG. 17, an annular ridge 26 is located near the to end of the cylindrical extension 24. Positioned below the annular ridge 26 is an annular recess 314. The annular ridge 26 merges into the annular recess 314 by way of an annular tapering portion 315 and the annular recess 314 also merges into the remaining portion of the extension 24 by way of an annular tapering portion 313. The interior of the cap 14 is provided with a first cylindrical part 316, an inwardly tapering part 318, a second cylindrical part 320 and an outwardly tapering part 322. The inner diameter of the first cylindrical part 316 is greater than the inner diameter of the second cylindrical part 320.

The above-described arrangement of the extension 24 and the interior of the cap 14 is particularly advantageous in several respects. The first cylindrical part 316 of the cap 14 possesses an inner diameter that is preferably slightly greater than the outer diameter of the extension 24 so that as the cap 14 is closed onto the base member 12, the first cylindrical part 316 of the cap 14 is able to move past and clear the extension 24. The extension 24 does not contact the cap 14 until the annular ridge 26 comes into contact with the inwardly tapering part 318. Thus, the closing of the cap 14 onto the base member 12 is facilitated.

The foregoing arrangement also provides the reclosable attachment 300 with an extremely effective airtight and liquid-tight seal. As can be seen from FIG. 19, when the cap 14 is closed upon the base member 12, the annular ridge 26 on the extension 24 is seated in the recess 13 in the cap. Also, the outwardly tapering part 322 o the interior of the cap 14 tightly engages the annular tapering portion 315 on the extension 24 while the inwardly tapering part 318 on the interior of the cap 14 tightly engages the annular tapering portion 313 on the extension 24. Further, the annular recess 314 on the cylindrical extension 24 receives the second cylindrical part 320 on the interior of the cap. It is also to be noted that the free end 34' of the annular seal 34 in the cap 14 is tapered to help guide the annular ridge 26 into the recess 13.

The above-described interaction between the inner surface of the cap 14 and the cylindrical extension 24 not only provides an extremely effective airtight and liquid-tight seal but in addition, provides substantial resistance against inadvertent opening of the cap 14. It has been found that the third embodiment of the reclosable attachment 300 requires approximately at least 15 pounds of force and up to approximately 30 pounds of force to open the cap 14. Thus, the third embodiment of the reclosable attachment 300 is well suited for preventing inadvertent opening of the cap 14 that might result from movement of the contents during shipment. The configuration of the cap 14 and the cylindrical extension 24 according to the third embodiment is particularly useful in conjunction with containers that are to be used for holding contents that must be shaken prior to use. The secure attachment of the cap 14 to the base member 12 as provided by the third embodiment of the reclosable attachment 300 permits the container to be shaken without a substantial risk that the contents will force the cap 14 to open.

It is also to be noted from a comparison of FIGS. 1 and 17 that the first cylindrical part 316 of the cap 14 according to the third embodiment provides a cap 14 whose axial dimension is slightly greater than the corresponding dimension of the cap utilized in the first embodiment. The cylindrical extension 24 in the third embodiment of the attachment 300 also possesses a greater axial dimension to accommodate the greater axial length of the cap 14. As a result, a greater distance is provided between the outer surface of the container and the underside 44' of the release tab 44, thereby making it easier to flip open the cap 14.

The reclosable attachment 300 as seen in FIG. 15 also includes two annular ridges 330, 332 that are integrally formed with and extend axially away from the bottom surface 23 of the flange member 20. One of the annular ridges 330 extends around the flange member 20 adjacent the outer periphery of the flange member 20. The other annular ridge 332 is positioned adjacent the stem 110.

The annular ridges 330, 332 are particularly useful when an adhesive is used to secure the reclosable attachment 300 to the container. The annular ridge 330 serves the function of ensuring that the adhesive does not flow outwardly beyond the outer edges of the flange member 20. As a result, the clean and attractive appearance of the container is not adversely affected. The other annular ridge 332 serves the function of preventing the adhesive from flowing radially inwardly toward the stem 110 so that the adhesive is not able to flow between the outer peripheral surface of the stem 110 and the inner periphery of the hole in the container. Consequently, it is not possible for the adhesive to flow into the container and contaminate the contents thereof. Moreover, the ridges 330, 332 concentrate the adhesive in a confined annular area to further ensure proper securement of the attachment to the container.

To further ensure proper securement of the attachment to the container, the bottom surface 23 of the flange member 20 can be chemically etched prior to application of the adhesive. The chemical etching can increase the surface area of the flange member 20, thereby providing more surface area for securement to the container.

Chemical bonding is also a suitable method of attaching the reclosable attachment to the container. As is known, the chemical bonding of two dissimilar materials, such as the material from which the reclosable attachment is fabricated and the material from which the container is made, involves the application of a chemical to one or both of the reclosable attachment and the container to cause the two parts to be secured to one another. This process may take longer to sufficiently set so as to permit further manipulation of the attachment but may, nevertheless, be suitable for certain applications.

While the third embodiment of the reclosable attachment 300 is particularly well suited for being attached to containers through the use of an adhesive, it is to be understood that means other than adhesives could be utilized to secure the reclosable attachment 300 to the container. For example, one of the other attaching means mentioned above in connection with the first embodiment could be employed. The annular ridges 330, 332 could be employed in connection with those alternative attaching means if those alternative attaching means present problems similar to those presented by the use of adhesives that the annular ridges 330, 332 are effective in overcoming.

Figure 16:
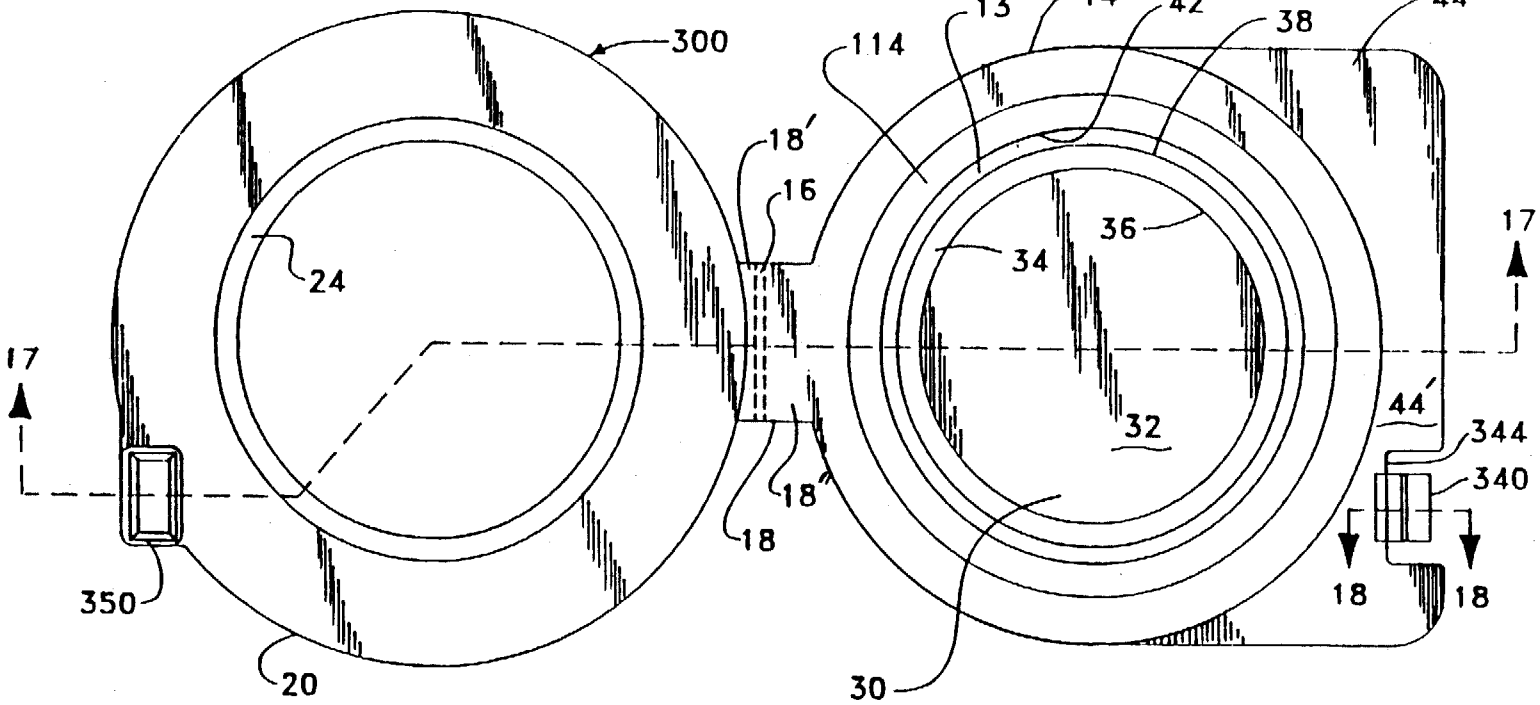
FIG. 16 is a top plan view of the reclosable attachment according to the third embodiment of the present invention.

The reclosable attachment 300 also includes a tamper evident and accidental opening preventive feature. With reference initially to FIGS. 15 and 16, that tamper evident and accidental opening preventive feature includes a projection 340 that is integrally formed with and extends from the underside 44' of the release tab 44 and a projection receiver 350 that is integrally formed with and extends from the flange member 20.

Figure 18:
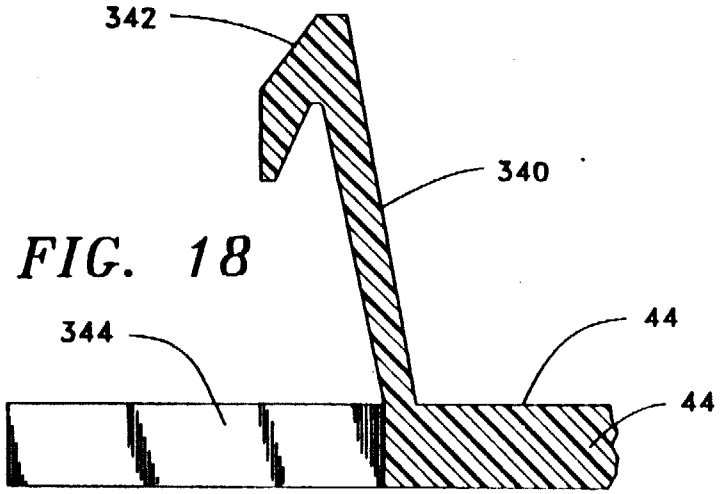
FIG. 18 is a cross-sectional view of a portion of the reclosable attachment according to the third embodiment along the section line 18—18 in FIG. 16.

In the preferred embodiment, the projection 340 is positioned in a U-shaped cut-out 344 formed in the release tab 44. As best seen in FIG. 18, the projection 340 is generally J-shaped with a somewhat V-shaped free end portion 342.

As best seen in FIG. 17, the projection receiver 350 is hollow and has open top and bottom ends. At the top end of the projection receiver 350, an overhanging portion 352 extends inwardly toward the interior of the projection receiver 350.

During manufacture of the reclosable attachment 300, the cap 14 is closed onto the base member 12, whereupon the projection 340 is pushed into the projection receiver 350. The V-shaped free end 342 of the projection 340 is flexible enough to be pushed past the overhanging portion 352 of the projection receiver 350. When the reclosable attachment 300 is in the closed position illustrated in FIG. 19, the V-shaped free end 342 of the projection 340 is positioned underneath the overhanging portion 352 of the projection receiver 350 and is prevented from being pulled upwardly out of the projection receiver 350.

When the cap 14 is opened for the first time, the projection 340 breaks away from the underside 44' of the release tab 44 and falls into the interior of the projection receiver 350. The projection 340 cannot fall through the open bottom end of the projection receiver 350 due to the presence of the underlying container. Similarly, the projection 340 cannot fall through the open top of the projection receiver 350 due to the overhanging portion 352 of the projection receiver 350. Thus, the projection 340 remains trapped in the hollow interior of the projection receiver 350 and cannot fall into the container.

It should be understood that the tamper evident and accidental opening preventive feature illustrated in connection with the third embodiment of the reclosable attachment 300 could be utilized in the other embodiments of the reclosable attachment described above. Likewise, any of the embodiments of the tamper evident and accidental opening preventive feature illustrated in FIGS. 6–10 could be utilized in the embodiment of the reclosable attachment depicted in FIGS. 15–17 and 19.

As can be seen from FIG. 19, the reclosable attachment 300 according to the third embodiment is preferably configured such that when the cap 14 is in the closed position, the bottom surface 31 of the cap 14 is slightly spaced from the top surface 21 of the flange member 20. Also, it is to be understood that the release tab 44 utilized in connection with the third embodiment of the reclosable attachment 300 can be configured in the manner described above with respect to FIG. 3 or FIG. 5 to thereby facilitate opening of the cap 14.

The principles, preferred embodiments and modes of operation of the present invention have been described in the foregoing specification. The invention that is intended to be protected herein should not, however, be construed as limited to the particular forms disclosed, as these are to be regarded as illustrative rather than restrictive. Variations and changes may be made by others and equivalents employed without departing from the spirit of the present invention. Accordingly, the foregoing detailed description should be considered exemplary in nature and it is expressly intended that all such variations, changes and equivalents which fall within the spirit and scope of the present invention as set forth in the attached claims, be embraced thereby.

What is claimed is:

1. A reclosable attachment for containers comprising:

a flange member having a first side, an oppositely positioned second side, and an aperture extending through the flange member from the first side to the second side, said flange member having a plurality of spaced apart knockout portions integrally formed in one piece with an outer periphery of the flange member and extending radially outwardly therefrom, said knockout portions having a bottom surface that lies in a plane which is axially spaced from the first side of the flange member;

an extension integrally connected to and formed in one piece with the second side of the flange member and extending axially outwardly therefrom, said extension having a hole extending therethrough that is coaxially aligned with the aperture in the flange member;

a stem integrally formed in one piece with and extending axially from the first side of the flange member, said stem having a hole extending therethrough that is coaxially aligned with the hole in the extension and the aperture in the flange member;

a cap adapted to engage the extension when the cap is in a closed position to prevent pourable material from being discharged through the extension and adapted to be disengaged from the extension when the cap is in an open position to permit pourable material to be discharged through the extension, said cap having an axially extending recess into which fits the extension when the cap is in the closed position, said extension having an axial length that is substantially equal to an axial depth of the recess in the cap so that when the cap is in the closed position a bottom end face of the cap essentially contacts the second side of the flange member;

connecting means for connecting the cap to the flange member, said connecting means being integrally formed in one piece with the flange member and the cap, said connecting means including a first connecting portion that extends radially outwardly from the outer periphery of the flange member, said first connecting portion having a first side that faces in the same direction as the first side of the flange member and that is axially spaced from the first side of the flange member; and a release tab integrally formed in one piece with the cap and extending outwardly from the cap, said release tab having a top surface that lies in substantially the same plane as a top end face of the cap which is positioned opposite said bottom end face, said release tab having a length such that when the cap is in the closed position, a free end of the release tab extends at least approximately to the outer periphery of the flange member.

2. A reclosable attachment for containers comprising:

a flange member having a first side that is adapted to rest against a side wall of the container, an oppositely positioned second side and an aperture extending through the flange member from the first side to the second side, said first side of the flange member having an annular ridge extending axially therefrom, said annular ridge being positioned adjacent an outer edge of the flange member;

an extension integrally connected to and formed in one piece with the second side of the flange member and extending axially outwardly therefrom, said extension having a hole extending therethrough that is coaxially aligned with the aperture in the flange member;

a stem integrally connected to and formed in one piece with the first side of the flange member and extending axially outwardly therefrom for being positioned in a hole in the container, said stem having a hole extending therethrough that is coaxially aligned with the aperture in the flange member and the hole in the extension;

a cap adapted to engage the extension when the cap is in a closed position to prevent pourable material from being discharged through the stem and the extension and adapted to be disengaged from the extension when the cap is in an open position to permit pourable material to be discharged through the stem and the extension, said cap having an axially extending recess into which fits the extension when the cap is in the closed position; and connecting means for connecting the cap to the flange member, said connecting means being integrally formed in one piece with the flange member and the cap.

3. The reclosable attachment according to claim 2, wherein an axial depth of the recess in the cap is substantially equal to an axial length of the extension so that when the cap is in the closed position, a bottom end face of the cap contacts the second side of the flange member.

4. The reclosable attachment according to claim 2, wherein said connecting means includes first and second connecting portions that are hingedly connected together for permitting the second connecting portion to pivot relative to the first connecting portion, said first connecting portion being connected to the flange member such that a fist side of the first connecting portion which faces in the same direction as the first side of the flange member is axially spaced from the first side of the flange member, said cap having a bottom end face that faces the second side of the flange member when the cap is in the closed position, said second connecting portion being connected to the cap such that a firs side of the second connecting portion which faces in the same direction as the bottom end face of the cap is coplanar with the bottom end face of the cap.

5. The reclosable attachment according to claim 4, including a release tab integrally formed in one piece with the cap and extending outwardly from a peripheral outer surface of the cap, said release tab having a top surface that lies in substantially the same plane as a top end face of the cap which is positioned opposite the bottom end face of the cap, said release tab having a length such that when the cap is in the closed position, an end of the release tab extends at least approximately to the outer periphery of the flange member.

6. The reclosable attachment according to claim 2, wherein said stem and extension are cylindrically shaped.

7. The reclosable attachment according to claim 5, including means for preventing accidental opening of the cap and for indicating that the reclosable attachment has been tampered with.

8. The reclosable attachment according to claim 7, wherein said means for preventing accidental opening of the cap and for indicating that the reclosable attachment has been tampered with includes at least one post secured to a bottom surface of the release tab and integrally connected to the second side of the flange member.

9. The reclosable attachment according to claim 7, wherein said means for preventing accidental opening of the cap and for indicating that the reclosable attachment has been tampered with includes two posts secured to opposite edges of said release tab and integrally connected to the first side of the flange member.

10. The reclosable attachment according to claim 7, wherein said means for preventing accidental opening of the cap and for indicating that the reclosable attachment has been tampered with includes a plurality of spaced apart blocks integrally connected to the outer surface of the cap and secured to the second side of the flange member, said blocks being unable to be disconnected from the second side of the flange without being evident.

11. The reclosable attachment according to claim 7, wherein said means for preventing accidental opening of the cap and for indicating that the reclosable attachment has been tampered with includes a plurality of spaced apart elongated connecting arms integrally connected to the outer surface of the cap and secured to the second side of the flange member.

12. The reclosable attachment according to claim 7, wherein said means for preventing accidental opening of the cap and for indicating that the reclosable attachment has been tampered with includes a projection connected to and extending from the release tab and a projection receiver connected to and extending from the flange member, said projection receiver having a hollow interior with an overhanging position that overlies a portion of the interior, said projection having a generally V-shaped free end portion adapted to be received in the hollow interior of the projection receiver and adapted to be retained in the hollow interior upon initial opening of the cap due to the overhanging portion.

13. The reclosable attachment according to claim 2, including a plurality of spaced apart ledges formed integrally with and extending substantially radially outwardly from an outer peripheral surface of the stem.

14. A container for holding pourable material comprising:

a container body having an exterior surface, an interior and an opening that extends through the container body for permitting the pourable material to be discharged from the interior of the container body; and a reclosable attachment secured to the container, said reclosable attachment including:

a flange member having a first side that lies in a first plane, an oppositely positioned second side and an aperture extending through the flange member from the first side to the second side;

an extension integrally connected to and formed in one piece with the second side of the flange member and extending axially outwardly therefrom, said extension having a hole extending therethrough that is coaxially aligned with the aperture in the flange member;

a stem integrally connected to and formed in one piece with the first side of the flange member and extending axially outwardly therefrom, said stem having a hole extending therethrough that is coaxially aligned with the hole in the extension and the aperture in the flange member, said stem being positioned in the opening in the container body and said first side of the flange member being attached to the exterior surface of the container body by means for attaching, the portion of the container body underlying said flange member being positioned below said first plane, said stem having a ledge extending outwardly from the stem and around at least a portion of an outer periphery of the stem, said stem being provided with said ledge prior to positioning of the stem in the opening in the container;

a cap adapted to engage the extension when the cap is in a closed position to prevent the pourable material from being discharged through the stem and the extension and adapted to be disengaged from the extension when the cap is in an open position to permit the pourable material to be discharged through the stem and the extension, said cap having an axially extending recess into which fits the extension when the cap is in the closed position; and connecting means for connecting the cap to the flange member and for permitting the cap to pivot relative to the flange member, said connecting means being integrally formed in one piece with the cap and the flange member.

15. The container according to claim 14, wherein an axial depth of the recess in the cap is substantially equal to the axial length of the extension so that when the cap is in the closed position a bottom end face of the cap essentially contacts the second side of the flange member.

16. The container according to claim 14, wherein said connecting means includes first and second connecting portions that are hingedly connecting together for permitting the second connecting portion to pivot relative to the first connecting portion, said first connecting portion being connected to the flange member such that a first side of the first connecting portion which faces in the same direction as the first side of the flange member is axially spaced from the first side of the flange member, said cap having a bottom end face that faces the second side of the flange member when the cap is in the closed position, said second connecting portion being connected to the cap such that a first side of the second connecting portion which faces in the same direction as the bottom end face of the cap is coplanar with the bottom end face of the cap.

17. The container according to claim 14, further comprising a release tab integrally formed in one piece with the cap and extending outwardly from a peripheral outer surface of the cap, said release tab having a top surface that lies in substantially the same plane as a top end face of the cap which is positioned opposite the bottom end face of the cap, said release tab having a length such that when the cap is in the closed position, an end of the release tab extends at least approximately to the outer periphery of the flange member.

18. The container according to claim 14, wherein an axial length of the stem is substantially equal to the thickness of the container so that an end of the stem lies substantially flush with an inner surface of the container.

19. The container according to claim 17, including means for preventing accidental opening of the cap and for indicating that the reclosable attachment has been tampered with.

20. The container according to claim 19, wherein said means for preventing accidental opening of the cap and for indicating that the reclosable attachment has been tampered with includes a projection connected to and extending from the release tab and a projection receiver connected to and extending from the flange member, said projection receiver having a hollow interior with an overhanging portion that overlies a portion of the interior of the projection receiver, said projection having a generally V-shaped free end portion adapted to be received in the hollow interior of the projection receiver and adapted to be retained in the hollow interior upon initial opening of the cap due to the overhanging portion.

21. The container according to claim 14, including a plurality of spaced apart ledges formed integrally with and extending substantially radially outwardly from an outer peripheral surface of the stem.

22. The container according to claim 14, including two annular ridges extending axially from the first side of the flange member, a first one of said annular ridges being positioned adjacent an outer edge of the flange member and a second one of said annular ridges being positioned adjacent said stem.

23. The container according to claim 22, wherein the first side of the flange member is chemically etched and secured to the exterior surface of the container by adhesive, said first and second annular ridges serving to maintain and concentrate the adhesive between the first and second annular ridges.

24. The container according to claim 14, wherein the first side of the flange member is secured to the exterior surface of the container by chemical bonding.

25. The container according to claim 14, including means extending outwardly from an outer peripheral surface of said stem and extending around at least a portion of the circumference of the stem for engaging an inner surface of the container, a wall of the container being positioned between the flange member and the means for engaging and the means for engaging contacting the inner surface of the container.

26. The container according to claim 25, wherein said means for engaging extends around at least one half of the circumference of the stem and is integrally formed with the stem prior to when the stem is positioned in the means for defining an opening in the container body, the distance between the second side of the flange member and a facing side of the means for engaging being substantially equal to the thickness of the container wall.

27. The container according to claim 14, wherein said container body is fabricated from a laminated paper material.

28. The container according to claim 25, wherein said means for engaging includes at least one ledge formed integrally with the stem and having an upper surface that is substantially parallel to the first side of the flange member.

29. A reclosable attachment for containers comprising:

a flange member having a first side, an oppositely positioned second side and an aperture extending through the flange member from the first side to the second side;

an extension integrally connected to and formed in one piece with the second side of the flange member and extending axially outwardly therefrom, said extension having a hole extending therethrough that is coaxially aligned with the aperture in the flange member;

a stem integrally connected to and formed in one piece with the first side of the flange member and extending axially outwardly therefrom for being positioned in a hole in a container, said stem having a hole extending therethrough that is coaxially aligned with the aperture in the flange member; and a cap connected to the flange member, said cap being adapted to engage the extension when the cap is in a closed position to prevent contents in the container from being discharged through the stem and the extension and being adapted to be disengaged from the extension when the cap is in an open position to permit the contents of the container to be discharged through the stem and the extension, said cap having a projection extending therefrom and said flange member having a hollow projection receiver connected thereto, said projection receiver opening to a top end thereof, at least a portion of the projection being received within the projection receiver, and including means for preventing the projection from being withdrawn from the projection receiver so that when the cap is moved to the open position for the first time with the attachment connected to a container, the projection breaks away from the cap, falls into the projection receiver and is retained within the projection receiver.

30. The reclosable attachment according to claim 29, wherein said means for engaging includes four spaced apart ledges extending outwardly from the outer peripheral surface of the stem, each of said ledges being axially spaced from the first side of the flange member.

31. The reclosable attachment according to claim 30, wherein the first side of the flange member has a first annular ridge extending axially therefrom said first annular ridge being positioned adjacent an outer edge of the flange member.

32. The reclosable attachment according to claim 31, wherein the first side of the flange member has a second annular ridge extending axially therefrom, said second annular ridge being positioned adjacent said stem.

33. The reclosable attachment according to claim 29, including a release tab integrally formed with and extending from the cap and a projection connected to and extending from the release tab, said projection having a substantially V-shaped free end portion, and also including a projection receiver integrally formed with and extending from the flange member, said projection receiver having a hollow interior that opens to a top end thereof, the top end of the projection receiver having an overhanging portion that overlies a portion of the interior of the projection receiver, said projection being adapted to be positioned in the interior of said projection receiver with the V-shaped end portion disposed under the overhanging portion so that when the cap is moved from the closed position to the open position for the first time, the connection between the projection and the release tab is broken while the projection remains in the projection receiver.

34. The reclosable attachment according to claim 29, wherein said cap includes a recess defining a closed top end and an open bottom end, said recess having an inner peripheral surface defined by a first cylindrical part, inwardly tapering portion that tapers toward an axial center of the cap, a second cylindrical part, and an outwardly tapering portion that tapers away from the axial center of the cap, said first cylindrical part opening to the open bottom end and merging into the inwardly tapering portion, said inwardly tapering portion merging into the second cylindrical part and the second cylindrical part merging into the outwardly tapering portion, said cap having an annular ridge extending from an inner surface of the top end thereof and an annular groove defined between an outer peripheral surface of the annular ridge on the cap and a facing portion on the inner peripheral surface of the recess, said cylindrical extension having an annular ridge formed at a free end thereof and an annular recess formed in an outer surface thereof that mergers into said annular ridge at the free end of the extension, said cap being adapted to interact with the cylindrical extension such that when the cap is in the closed position, the annular ridge on the extension is received in the annular groove on the cap while the second cylindrical part of the inner periphery of the cap engages the annular recess formed on the outer surface of the cylindrical extension.

35. The reclosable attachment according to claim 29, wherein said means for engaging includes at least one ledge formed integrally with said stem and having an upper surface that is substantially parallel to the first side of the flange member.

36. The reclosable attachment according to claim 29, wherein said cap is resealable with respect to the extension.

37. The reclosable attachment according to claim 36, wherein said extension includes an outwardly directed annular ridge at its end positioned remote from the flange member, said cap having an annular seal extending generally axially from an inner end surface thereof and an annular recess defined between the annular seal and an inner surface of a generally axially extending wall portion of the cap, said annular ridge being positioned in the annular recess when the cap is in the closed position to thereby contribute to the resealability of the cap.

38. The reclosable attachment according to claim 37, wherein said annular ridge merges into an annular recess formed in an outer peripheral surface of the extension, and wherein the generally axially extending wall portion of cap merges into an inwardly tapering wall portion, said inwardly tapering wall portion merging into an generally cylindrical wall portion, said generally cylindrical wall portion merging into an outwardly tapering wall portion, the generally cylindrical wall portion being positioned in the annular recess formed on the outer periphery of the extension when the cap is in the closed position, thereby contributing to the resealability of the cap.

39. The reclosable attachment according to claim 29, wherein said means for preventing the projection from being withdrawn from the projection receiver includes said projection being provided with a substantially V-shaped free end portion and said projection receiver being provided with an overhanging portion adjacent the top end thereof.

40. The reclosable attachment according to claim 29, wherein said projection receiver has an open bottom end.

41. A reclosable attachment for containers comprising:

a flange member having a first side, an oppositely positioned second side and an aperture extending through the flange member from the first side to the second side, said flange member having a first annular ridge integrally formed with and extending axially from the first side of the flange member;

an extension integrally connected to and formed in one piece with the second side of the flange member and extending axially outwardly therefrom, said extension having a hole extending therethrough that is coaxially aligned with the aperture in the flange member;

a stem integrally connected to and formed in one piece with the first side of the flange member and extending axially outwardly therefrom for being positioned in a hole in the container, said stem having a hole extending therethrough that is coaxially aligned with the aperture in the flange member; and a cap connected to the flange member and adapted to be moved between a closed position for preventing contents in the container from being discharged through the stem and the extension and an open position for permitting the contents in the container to be discharged through the stem and the extension.

42. The reclosable attachment according to claim 41, wherein said first annular ridge extends around the flange member adjacent an outer edge of the flange member.

43. The reclosable attachment according to claim 42, including a second annular ridge integrally formed with and extending from the first side of the flange member, said second annual ridge being positioned adjacent to and encircling said stem.

44. The reclosable attachment according to claim 43, including a release tab extending from the cap, a projection connected to and extending from the release tab, and a projection receiver integrally formed with and extending from the flange member, said projection having a substantially V-shaped free end portion and said projection receiver having a hollow interior that opens to a top end of the projection receiver, the top end of the projection receiver having an overhanging portion that overlies a portion of the interior of the projection, said projection receiver being adapted to receive said projection and to retain the projection in the hollow interior thereof after the cap has been moved to the open position for the first time.

45. The reclosable attachment according to claim 41, including a plurality of spaced apart ledges integrally formed with and extending substantially radially outwardly from an outer peripheral surface of the stem.

46. The reclosable attachment according to claim 41, wherein said cap includes a recess defining a closed top end and an open bottom end, said recess having an inner peripheral surface defined by a first cylindrical part, an inwardly tapering portion that tapers toward an axial center of the cap, a second cylindrical part, and an outwardly tapering portion that tapers away from the axial center of the cap, said first cylindrical part opening to the open bottom end and merging into the inwardly tapering portion, said inwardly tapering portion merging into the second cylindrical part and the second cylindrical part merging into the outwardly tapering portion, said cap having an annular ridge extending from an inner surface of the top end thereof and an annular groove defined between an outer peripheral surface of the annular ridge on the cap and a facing portion on the inner peripheral surface of the recess, said cylindrical extension having an annular ridge formed at a free end thereof and an annular recess formed in an outer surface thereof that mergers into said annular ridge at the free end of the extension, said cap being adapted to interact with the cylindrical extension such that when the cap is in the closed position, the annular ridge on the extension is received in the annular groove on the cap while the second cylindrical part of the inner periphery of the cap engages the annular recess formed on the outer surface of the cylindrical extension.

47. A reclosable attachment for containers comprising:

a flange member having a first side that is adapted to rest against a side wall of the container, an oppositely positioned second side and a aperture extending through the flange member from the first side to the second side;

an extension integrally connected to and formed in one piece with the second side of the flange member and extending axially outwardly therefrom, said extension having a hole extending therethrough that is coaxially aligned with the aperture in the flange member;

a stem integrally connected to and formed in one piece with the first side of the flange member and extending axially outwardly therefrom for being positioned in a hole in the container. said stem having a hole extending therethrough that is coaxially aligned with the aperture in the flange member and the hole in the extension;

a cap adapted to engage the extension when the cap is in a closed position to prevent pourable material from being discharged through the stem and the extension and adapted to be disengaged from the extension when the cap is in an open position to permit pourable material to be discharged through the stem and the extension, said extension including an outwardly directed annular ridge at its end positioned remote from the flange member, said cap having an annular seal extending generally axially from an inner end surface thereof and an annular recess defined between the annular seal and an inner surface of a generally axially extending wall portion of the cap, said annular ridge merging into an annular recess formed in an outer peripheral surface of the extension, the generally axially extending wall portion of the cap being positioned adjacent a portion of the wall of the cap that is configured to cooperate with the annular ridge and the annular recess of the extension when the cap is in the closed position in a manner that contributes to resealability of the cap.

48. The reclosable attachment according to claim 47, wherein said generally axially extending wall portion of the cap merges into an inwardly tapering wall portion, said inwardly tapering wall portion merges into a generally cylindrical wall portion, and said generally cylindrical wall portion merges into an outwardly tapering wall portion, said annular ridge being positioned in the annular recess when the cap is in the closed position and the generally cylindrical wall portion being positioned in the annular recess formed on the outer periphery of the extension when the cap is in the closed position.

49. A reclosable attachment for containers comprising:

a flange member having a first side that is adapted to rest against a side wall of the container, an oppositely positioned second side and a aperture extending through the flange member from the first side to the second side;

an extension integrally connected to and formed in one piece with the second side of the flange member and extending axially outwardly therefrom, said extension having a hole extending therethrough that is coaxially aligned with the aperture in the flange member;

a stem integrally connected to and formed in one piece with the first side of the flange member and extending axially outwardly therefrom for being positioned in a hole in the container, said stem having a hole extending therethrough that is coaxially aligned with the aperture in the flange member and the hole in the extension;

a cap adapted to engage the extension when the cap is in a closed position to prevent pourable material from being discharged through the stem and the extension and adapted to be disengaged from the extension when the cap is in an open position to permit pourable material to be discharged through the stem and the extension, said cap having an axially extending recess into which fits the extension when the cap is in the closed position; and connecting means for connecting the cap to the flange member, said connecting means being integrally formed in one piece with the flange member and the cap, said connecting means including first and second connecting portions that are hingedly connected together for permitting the second connecting portion to pivot relative to the first connecting portion, said first connecting portion being connected to the flange member such that a first side of the first connecting portion which faces in the same direction as the first side of the flange member is axially spaced from the first side of the flange member, said second connecting portion being connected to the cap such that a first side of the second connecting portion which faces in the same direction as a bottom end face of the cap is coplanar with the bottom end face of the cap.

* * * * *